US008516844B2

(12) United States Patent
Kim et al.

(10) Patent No.: US 8,516,844 B2
(45) Date of Patent: Aug. 27, 2013

(54) ICE MAKER FOR REFRIGERATOR AND REFRIGERATOR HAVING THE SAME

(75) Inventors: Bongjin Kim, Seoul (KR); Younghoon Yun, Seoul (KR); Seunghwan Oh, Seoul (KR); Seongjae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 400 days.

(21) Appl. No.: 12/912,225

(22) Filed: Oct. 26, 2010

(65) Prior Publication Data

US 2011/0094254 A1 Apr. 28, 2011

(30) Foreign Application Priority Data

Oct. 26, 2009 (KR) ..... 10-2009-0101940
Oct. 26, 2009 (KR) ..... 10-2009-0101941
Nov. 3, 2009 (KR) ..... 10-2009-0105631

(51) Int. Cl.
*F25C 5/18* (2006.01)

(52) U.S. Cl.
USPC ..... 62/344; 62/354

(58) Field of Classification Search
USPC ..... 62/344, 353, 135, 137, 389, 354; 222/146.6
See application file for complete search history.

(56) References Cited

U.S. PATENT DOCUMENTS 4,838,026 A * 6/1989 Searl ..... 62/137
5,655,386 A * 8/1997 Huang et al. ..... 62/320
6,050,097 A * 4/2000 Nelson et al. ..... 62/137
7,278,275 B2 * 10/2007 Voglewede et al. ..... 62/320
7,707,847 B2 * 5/2010 Davis et al. ..... 62/344
7,874,460 B2 * 1/2011 Jang et al. ..... 222/146.6
7,891,208 B2 * 2/2011 Kim et al. ..... 62/354
8,011,202 B2 * 9/2011 Kim et al. ..... 62/344
8,024,940 B2 * 9/2011 Jang et al. ..... 62/389
8,104,304 B2 * 1/2012 Kang et al. ..... 62/344
2004/0187516 A1 * 9/2004 Lee ..... 62/389
2006/0065008 A1 * 3/2006 Park ..... 62/344
2006/0196214 A1 * 9/2006 Lee et al. ..... 62/344

FOREIGN PATENT DOCUMENTS

JP 6-070542 B2 9/1994
JP 11-304317 A 11/1999
KR 10-20050022967 A 3/2005
KR 10-0565498 B1 3/2006

OTHER PUBLICATIONS

PCT International Search Report and Written Opinion dated Jul. 11, 2011 for Application No. PCT/KR2010/007360, 11 pages.

* cited by examiner

*Primary Examiner* — Mohammad M Ali
(74) *Attorney, Agent, or Firm* — Fish & Richardson P.C.

(57) ABSTRACT

Disclosed herein is an ice maker for a refrigerator and a refrigerator having the same. The ice maker for a refrigerator may include an ice tray having a plurality of cells thereinside, an ejector configured to remove ice inside the cells, and a transfer unit configured to transfer the ice removed by the ejector in the length direction of the ice tray. Accordingly, the width of the ice maker can be reduced, thereby reducing the size of its occupied area in the width direction when the ice maker is provided therein.

18 Claims, 30 Drawing Sheets

ICE MAKER FOR REFRIGERATOR AND REFRIGERATOR HAVING THE SAME

CROSS-REFERENCE TO RELATED APPLICATIONS

The present disclosure relates to subject matter contained in priority Korean Application No. 10-2009-0101940 filed on Oct. 26, 2009, 10-2009-0101941 filed on Oct. 26, 2009 and 10-2009-0105631 filed on Nov. 3, 2009, which are herein expressly incorporated by reference in their entirety.

BACKGROUND OF THE INVENTION

1. Field of the Invention

The present disclosure relates to an ice maker for a refrigerator and a refrigerator having the same, and more particularly, to an ice maker for a refrigerator capable of preventing water overflow by external forces and a refrigerator having the same.

2. Description of the Related Art

As is generally known, a refrigerator is a device for refrigerating or freezing foods to keep them fresh. The refrigerator may include a refrigerator body formed with a plurality of cooling chambers therein, doors for opening and closing each cooling chamber, and a freezing cycle apparatus for providing cool air to the cooling chamber.

The freezing cycle apparatus may be typically provided with a vapor compression-type freezing cycle apparatus including a compressor for compressing refrigerant, a condenser for heat radiating and condensing refrigerant, an expansion apparatus for decompressing and expanding refrigerant, and an evaporator for allowing refrigerant to absorb and evaporate surrounding latent heat.

The refrigerator may be provided with an ice maker for making ice. Furthermore, the refrigerator may be provided with a dispenser for taking out water or ice without opening a door.

The ice maker may be disposed inside a freezing chamber. Furthermore, the ice maker may be provided at a door for space utilization in the refrigerator.

The ice maker may include an ice tray having a plurality of cells for making ice with a predetermined shape, and an ejector for taking out ice that has been formed inside the ice tray.

The ejector may be provided with a shaft disposed along the length direction of the ice tray, and a plurality of ejector pins formed to be protruded along the radial direction from the shaft to correspond to the cell. An ice bank for storing ice being removed and fallen from the ice maker may be provided at a lower side of the ice maker.

However, in such a refrigerator in the prior art, when the ice maker is provided at the door, water in the ice tray may be overflowed out of the ice tray when opening or closing the door in a state that water has been supplied to the ice tray. If water is overflowed, then it may be flowed into the ice bank at a lower side thereof, and thus ice stored inside the ice bank may be stuck to one another.

In addition, in such a refrigerator in the prior art, it is configured that an ejector is disposed in the length direction of the ice tray at an upper side of the ice tray, and the made ice is fallen to a lateral portion of the ice tray by the ejector when removing ice, and thus the ice bank should be disposed to be protruded from a lateral side of the ice tray to accommodate and store ice fallen from the ice tray. Due to this, the size of the ice maker is increased in the width direction.

Especially, when the ice maker and ice bank are provided at the freezing chamber door, the ice maker and/or ice bank is protruded from a rear side of the door, i.e., a side of the freezing chamber, and thus an interference with foods may be caused when storing foods in the space in the refrigerator (freezing chamber), thereby making it difficult to accommodate foods.

In addition, when an ice-making chamber is formed at the refrigerating chamber and the ice maker and ice bank are accommodated inside the ice making chamber, the thickness of the ice making chamber is increased, thereby reducing the space in the refrigerator.

SUMMARY OF THE INVENTION

In order to solve the foregoing problem, one aspect of the detailed description is to provide an ice maker for a refrigerator capable of suppressing water from being overflowed out of the ice tray and a refrigerator having the same.

Furthermore, another aspect of the detailed description is to provide an ice maker for a refrigerator capable of reducing the installation width of the ice maker and a refrigerator having the same.

In addition, still another aspect of the detailed description is to provide an ice maker for a refrigerator capable of suppressing water overflow of the ice tray and reducing the installation width of the ice maker and a refrigerator having the same.

In order to accomplish the foregoing objectives of the present invention, there is provided an ice maker for a refrigerator, including an ice tray having a plurality of cells; an ejector configured to remove ice formed in the cells; a transfer unit configured to transfer the ice that has been removed from the cells in the length direction of the ice tray.

Here, the ejector may include a shaft, a plate protruded at one side of the shaft, and a plurality of fingers protruded in a direction opposite to the plate at the other side of the shaft.

The ejector may be rotated forward or backward to allow the fingers to be revolved to pass through the cells.

The ejector may include a shaft; and a plurality of fingers protruded at both sides of the shaft.

The transfer unit may include a transfer screw; and a pusher moved along the transfer screw.

The ice maker may further include a cover configured to block an upper side of the ice tray.

The ice maker may further include an ice bank more protruded in the length direction of the ice tray, and disposed at a lower side of the ice tray to accommodate ice transferred by the transfer unit.

The transfer unit may include a screw shaft; a screw fin spirally protruded at the screw shaft; and a screw shaft driving unit for providing a driving force to the screw shaft.

The screw fin may have a semi-circular shape.

The ice maker may further include a cover for blocking an upper side of the ice tray.

The ice maker may further include an ice bank more protruded along the ice tray and disposed at a lower side of the ice tray to accommodate ice transferred by the transfer unit.

The ice maker may further include a controller configured to control the screw shaft driving unit.

The controller may control the screw shaft driving unit to allow the screw fin to be disposed at an upper side of the shaft when making ice.

On the other hand, according to another aspect of the present invention, there is provided an ice maker for a refrigerator, including an ice tray having a plurality of cells provided with an discharge port at the bottom portion; a damper configured to open and close the discharge port; and a damper driving unit configured to drive the damper.

Here, the damper may be vertically revolved around a revolving axis disposed at one side of the bottom portion of the ice tray.

The damper may open and close the discharge port while one side thereof moves horizontally and the other side thereof moves vertically.

The ice maker may further include a damper guide configured to guide the damper.

The damper may be brought into contact with the bottom portion of the ice tray to be revolved subsequent to its vertical movement when the discharge port is blocked.

The damper driving unit may include a lifting member being moved up and down; a connecting member for connecting the lifting member to the damper; and an elastic member for applying an elastic force to allow the lifting member and the connecting member to be vertically disposed, respectively.

The ice maker may further include a cover configured to block an upper opening of the ice tray.

The ice maker may further include an ejector configured to press the made ice of the ice tray.

On the other hand, according to still another aspect of the present invention, there is provided a refrigerator, including a refrigerator body formed with a cooling chamber; a door configured to open and close the cooling chamber; and an ice maker of the refrigerator.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the present invention will be described in detail with reference to the accompanying drawings.

Figure 1:
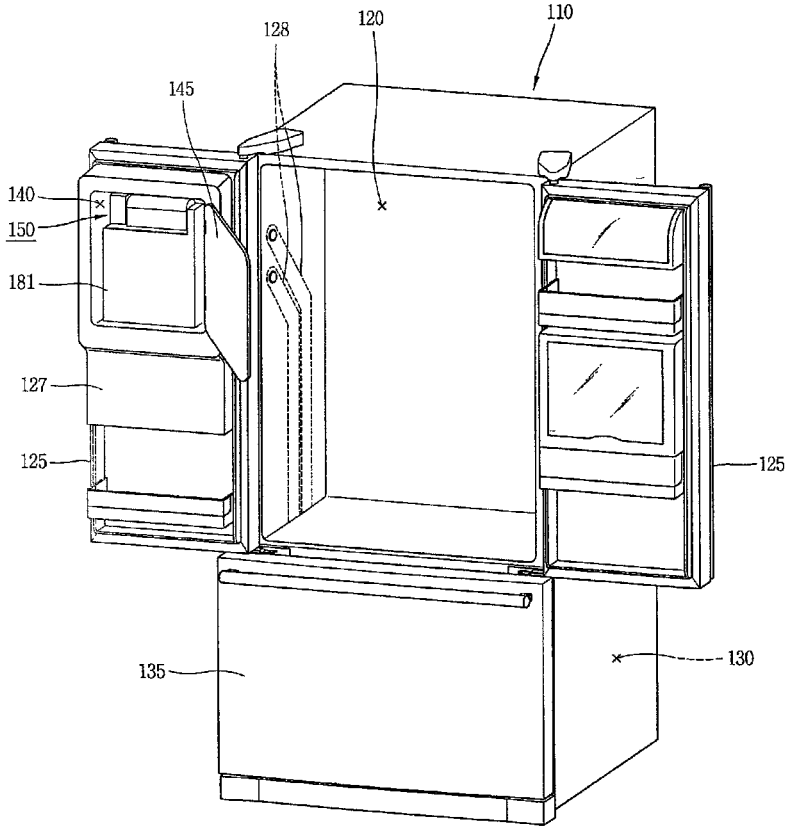
FIG. 1 is a perspective view illustrating a refrigerator according to an embodiment of the present invention.
Figure 2:
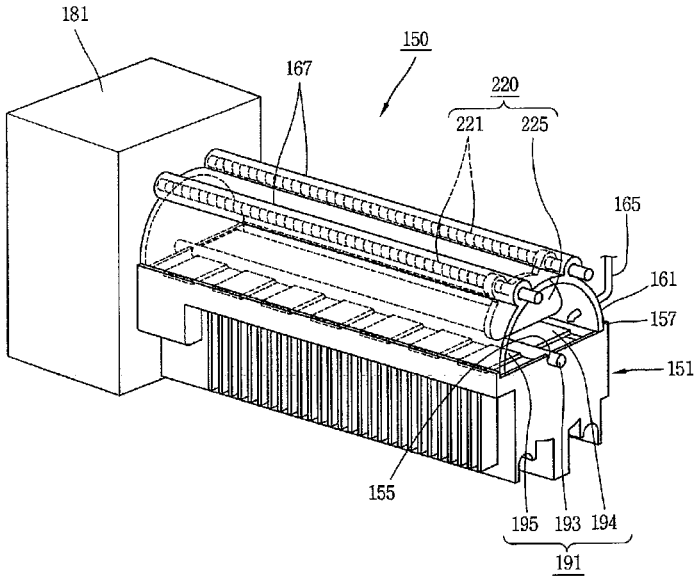
FIG. 2 is a perspective view illustrating an ice maker in FIG. 1.

As illustrated in FIG. 1, the refrigerator may include a refrigerator body 110 formed with cooling chambers 120, 130, doors 125, 135 for opening and closing the cooling chambers 120, 130, and an ice maker 150 provided at the refrigerator body 110 or the doors 125, 135. Here, the cooling chambers 120, 130 are commonly referred to a refrigerating chamber 120 and a freezing chamber 130, and the refrigerator body 110 may be configured to have either one of the refrigerating chamber 120 and refrigerating chamber 130. Hereinafter, a case where the refrigerator body 110 is provided with the refrigerating chamber 120 and freezing chamber 130, and the ice maker 150 is provided at the refrigerating chamber door 125 will be described as an example.

The refrigerating chamber 120 may be provided at an upper region of the refrigerator body 110. A refrigerating chamber door 125 may be provided at a front surface of the refrigerator body 110 to open and close the refrigerating chamber 120. There may be provided a plurality of refrigerating chamber doors 125. The refrigerating chamber door 125 may be revolvably combined with the refrigerator body 110. A dispenser 127 may be provided at the refrigerating chamber door 125 to take out water or ice without opening the refrigerating chamber door 125.

The freezing chamber 130 may be formed at a lower region of the refrigerator body 110. A freezing chamber door 135 may be provided at the freezing chamber 130 to open and close the freezing chamber 130. The freezing chamber door 135 may be slidably provided at the refrigerator body 110 to be slid forward and backward.

A freezing cycle (not shown) may be provided at the refrigerator body 110 to cool the freezing chamber 130 and/or refrigerating chamber 120. The freezing cycle may include a compressor for compressing refrigerant, a condenser for heat radiating refrigerant, an expansion apparatus for decompressing and expanding refrigerant, and an evaporator for allowing refrigerant to absorb and evaporate surrounding latent heat.

On the other hand, an ice making chamber 140 may be formed at the refrigerating chamber door 125. The ice making chamber 140 may be configured in an openable and closable manner. An opening may be formed at a rear end of the ice making chamber 140. An ice making chamber door 145 may be provided at a rear end of the ice making chamber 140 to open and close the opening of the ice making chamber 140. The ice making chamber door 145 may be revolvably combined therewith. A sidewall cool air duct 128 may be provided at the refrigerator body 110 to supply cool air produced in the freezing chamber 130 to the ice making chamber 140. There may be provided a plurality of sidewall cool air ducts 128. One of the sidewall cool air ducts 128 may be a cool air supply channel in which the cool air of the freezing chamber 130 is moved to the ice making chamber 140, and the other one may be referred to as a cool air return channel in which the cool air that has passed through the ice making chamber 140 is returned to the freezing chamber 130.

An ice maker 150 of the refrigerator may be provided inside the ice making chamber 140. The ice maker 150 may include an ice tray 151 provided with a plurality of cells 152, the upper side of which are opened thereinside; and a cover 161 for blocking the upper (side) opening of the ice tray 151. By this, water inside the ice tray 151 may be effectively prevented from being overflowed to the outside when opening and closing the refrigerating chamber door 125. A control box 171 may be provided at one side of the ice tray 151. An ice bank 181 may be provided inside the ice making chamber 140 to accommodate and store ice 156 that has been made and fallen from the ice maker 150.

A plurality of cells 152 that are opened at the upper side and separated from one other by partitions may be provided inside the ice tray 151. The ice tray 151 may be formed with a metal member. By this, heat or cool air can be rapidly transferred, thereby rapidly removing or making ice. Here, the removing ice means that the ice 156 made within the cell 152 is separated from an inner wall of the cell 152. The cross-section of the cell 152 may be formed with a semi-circular shape.

A heater 154 may be provided in the ice tray 151 to apply heat to the ice tray 151. The heater 154 may be configured with an electric heater 154 that is operated by electricity.

Figure 3:
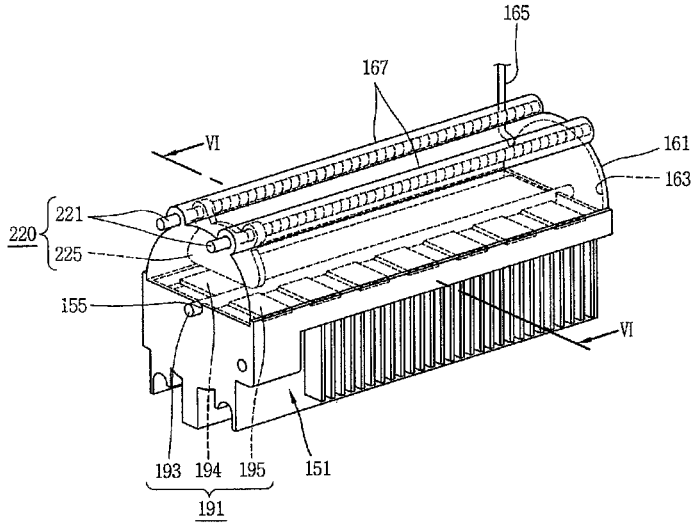
FIG. 3 is a perspective view illustrating an ice tray in a state that a control box is removed.
Figure 4:
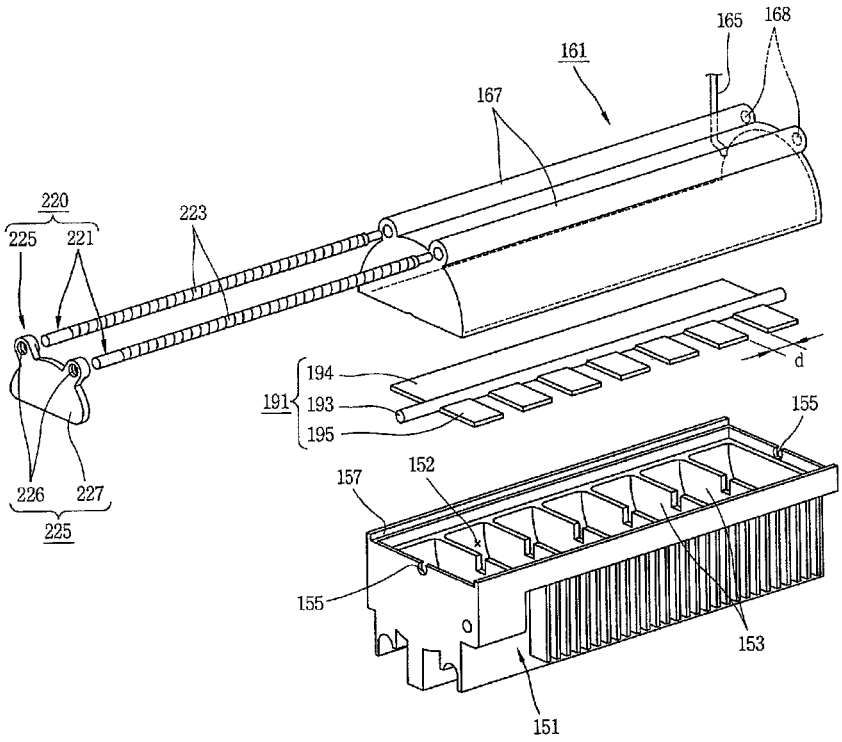
FIG. 4 is a separated perspective view of FIG. 3.

An ejector 191 may be provided at an upper side of the ice tray 151 to remove ice 156 that has been formed in the ice tray 151. As illustrated in FIGS. 3 and 4, the ejector 191 may include a shaft 193, a plate 194 protruded from one side of the shaft 193, and a plurality of fingers 195 protruded in a direction opposite to the plate 194. The shaft 193 may be disposed along the length direction of the ice tray 151. A shaft supporting portion 155 may be formed at the ice tray 151 to rotatably support the shaft 193. The shaft supporting portion 155 may be configured to partially accommodate the shaft 193 to rotatably support the shaft.

The fingers 195 may be configured to be protruded in a radial direction from an outer surface of the shaft 193 to correspond to each cell 152 of the ice tray 151. The fingers 195 presses ice 156 within the relevant cell 152 by passing through an inner portion of the each cell 152 to be rotated around the shaft 193, thereby removing the ice from the relevant cell 152. The each finger 195 may be formed to be apart from one another by a predetermined distance (d) to allow the partition 153 of the relevant cell 152 to be inserted therein.

The plate 194 may be configured such that the ice 156 that has been removed from the relevant cell 152 by the each finger 195 is placed thereon to be supported. The plate 194 may be formed in a long plate shape.

Figure 10:
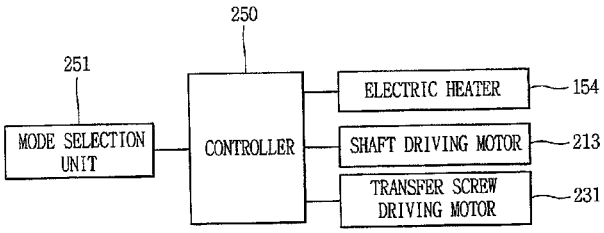
FIG. 10 is a modified example of an ejector in FIG. 4.

Here, the ejector 191, as illustrated in FIG. 10, may include a shaft 203, and a plurality of fingers 205 protruded with a predetermined length to be disposed on the same plane at both sides of the shaft 203. The shaft 203 may be disposed along the length direction at an upper side of the ice tray 151, and the each finger 205 may be inserted into the relevant cell 152 to be rotated. The each finger 205 may be disposed to be separated from one another by a predetermined distance (d) such that the partition 153 of the cell 152 can be inserted therebetween while being rotated. By this, the ejector 191 may be rotated by 180 degrees in any one direction regardless of its forward or backward rotation.

Figure 5:
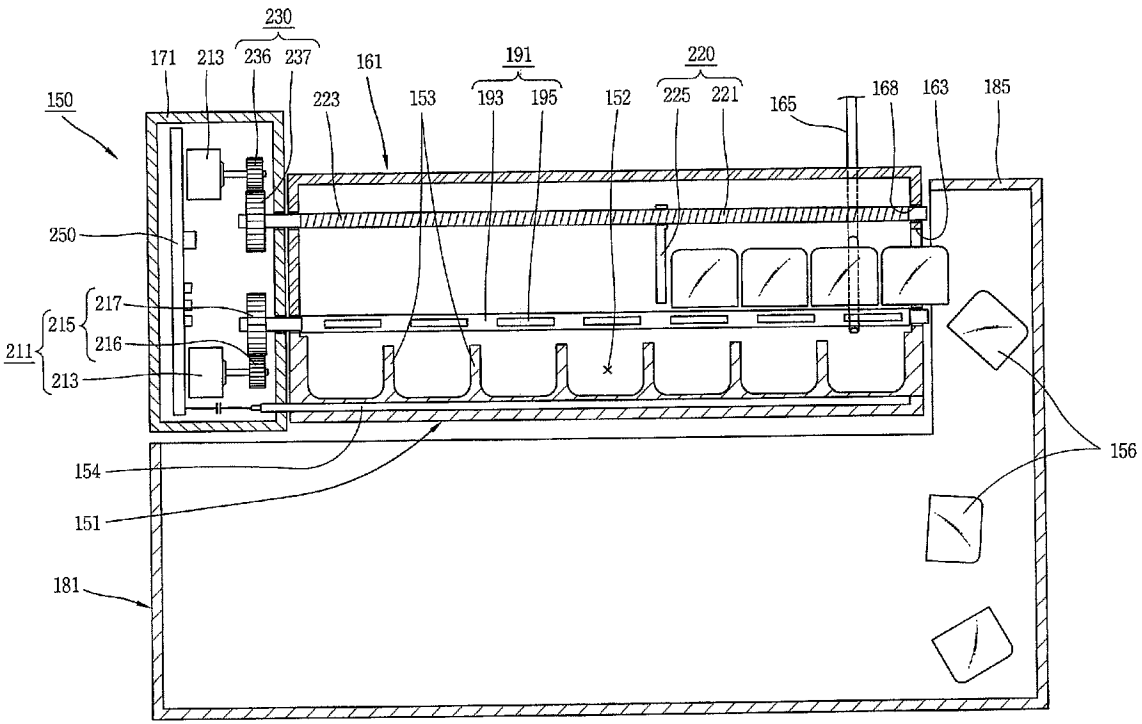
FIG. 5 is a longitudinal cross-sectional view of FIG. 2.
Figure 6:
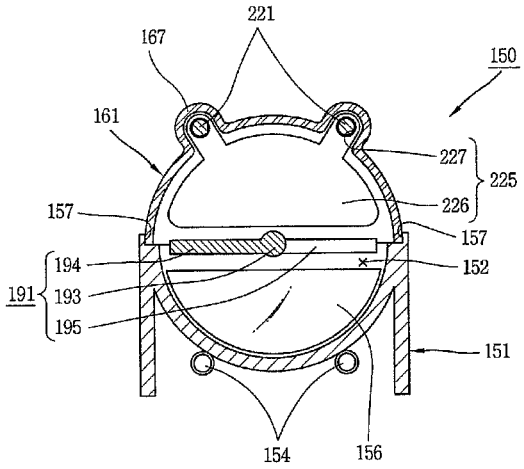
FIG. 6 is a cross-sectional view taken along the line VI-VI of the ice maker in FIG. 3.

The ejector 191 may further include an ejector driving portion 211 for rotating the shaft 193. The ejector driving portion 211 may be provided in the control box 171. As illustrated in FIG. 5, for example, the ejector driving portion 211 may include a shaft driving motor 213 for generating power, and a power transmission means 215 for transmitting a rotational force of the shaft driving motor 213 to the shaft 193.

The power transmission means 215 may include a plurality of gears 216, 217 engaged with each other to be rotated. Here, the power transmission means may be configured to transmit power by including a belt and a pulley, or may be configured by including a chain and a chain sprocket wheel, in addition to the plurality of gears. The shaft driving motor 213 may be configured to be rotated forward or backward, thereby rotating the ejector 191 forward or backward.

Here, as illustrated in FIG. 10, in case where the ejector 201 is configured to have fingers 205 protruded at both sides thereof, the shaft driving motor 213 for rotatably driving the shaft 203 may be configured with a motor capable of rotating in any one direction regardless of its forward or backward rotation.

On the other hand, a cover 161 may be provided at a circumference of the ejector 191 to block the upper opening of the ice tray 151. The cover 161 may be formed with a semi-circular shape, the cross section of which is opened downward. By this, the ejector 191 may be rotatably accommodated therein and does not occupy unnecessary internal space, thereby allowing compact configuration. Here, the cover 161 and ice tray 151 may further include a lock and release means (not shown) capable of maintaining a combining state when the ice tray 151 and the cover 161 are combined with each other, and releasing the combining state if necessary.

A sill 157 may be provided at an upper surface of the ice tray 151 to be disposed at an outside of the cover 161. By this, water may be more effectively prevented from being overflowed out of the ice tray 151.

An ice discharging port 163 for discharging ice 156 may be formed at one end of the cover 161 along the length direction thereof. Here, the cover 161 may be configured with a longer length such that a side of the ice discharging port 163 is more protruded along the length direction compared to the ice tray 151. To cope with this, an ice bank 181 may be provided at a lower side of the ice tray 151 to accommodate and store the falling ice 156. The ice bank 181 may be provided to be further protruded from a side of ice discharging port compared to the ice tray 151.

Here, the ice bank 181 may be configured to have the same width as that of the ice tray 151 right under the ice tray 151. By this, the installation width can be drastically reduced when installing the ice tray 151 and the ice bank 181.

An ice guide 185 disposed to block an end region of the cover 161 may be further provided at an upper region of the ice bank 181 to guide the falling ice 156 to an inner portion of the ice bank 181. The ice guide 185 may be integrally configured with the ice bank 181.

A water supply portion 165 may be provided in the ice tray 151 to supply water. The water supply portion 165 may be provided at the cover 161. The water supply portion 165 may be configured with a pipe.

On the other hand, a transfer unit 220 may be provided at an upper side of the ejector 191 to transfer the ice 156 that has been removed by the ejector 191. The transfer unit 220 may be configured to transfer the ice 156 in an axial direction.

The transfer unit 220, as illustrated in FIG. 4, may include a transfer screw 221, and a pusher 225 to be transferred while being combined with the transfer screw 221.

It may be configured with a plurality of transfer screws 221. An end of the transfer screw 221, as illustrated in FIG. 5, may be inserted into the control box 171. The transfer screw 221 may be rotatably supported by the control box 171. Here, the other end of the transfer screw 221 may be configured to be rotatably supported by the cover 161.

The pusher 225 may be formed in a plate shape. The pusher 225 may be formed in a semi-circular shape. The pusher 225 may have a female screw portion 227 to be screw-combined with a male screw portion 223 of the transfer screw 221. The pusher 225 may have a pair of female screw portions 227 formed at an upper region of the body 226 to be separated from the body 226. Here, the body 226 may be formed in a plate shape. The body 226 may be formed in a semi-circular shape. A linear side of the body 226 may be provided to face downward and the female screw portions 227 are formed at an upper region of the circumferential surface thereof to be separated from each other.

To cope with this, a transfer screw accommodation portion 167 may be formed to accommodate the transfer screw 221. The transfer screw accommodation portion 167 may be formed to be protruded outward and extended along the length direction. The transfer screw accommodation portion 167 may be provided with a transfer screw supporting portion 168 to rotatably support the transfer screw 221.

The transfer unit 220 may further include a transfer screw driving portion 230 for driving the transfer screw 221. The transfer screw driving portion 230 may include a transfer screw driving motor 231, and a power transmission means 235 for transmitting a driving force of the transfer screw driving motor 231 to the each transfer screw 221, for example. The power transmission means 235 may be configured by including a plurality of gears 236, 237. Here, the power transmission means may be also configured to transmit power by including a belt and a pulley, or may be configured by including a chain and a chain sprocket wheel, in addition to the plurality of gears.

Figure 9:
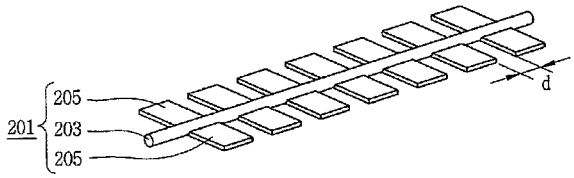
FIG. 9 is a control block diagram illustrating an ice maker in FIG. 1.

As illustrated in FIG. 9, the ice maker 150 may be configured by including a controller 250 having a control program. The controller 250 may be implemented by PCB as illustrated in FIG. 5. The controller 250 may be disposed inside the control box 171. The controller 250 may be connected to a mode selection unit 251 to select an operation mode such as an ice-making mode. The controller 250 may be controllably connected to a shaft driving motor 213, an electric heater 154, and a transfer screw driving motor 231, respectively, to control the process of making and removing ice when selecting an ice-making mode.

By such a configuration, when an ice-making mode is selected by the mode selection unit 251, water is supplied to the ice tray 151 through the water supply portion 165. The controller 250 applies power to the electric heater 154 if a predetermined time (a time for which the ice 156 is to be formed in the ice tray 151) has passed after supplying water.

If power is applied to the electric heater 154, then a boundary surface of the 156 contacted with a wall of the cell 152 of the ice tray 151 is dissolved. If it reaches a temperature or time at which a surface of the ice 156 inside the each cell 152 is to be dissolved, then the controller 250 controls the shaft driving motor 213 to rotate the ejector 191.

Figure 7:
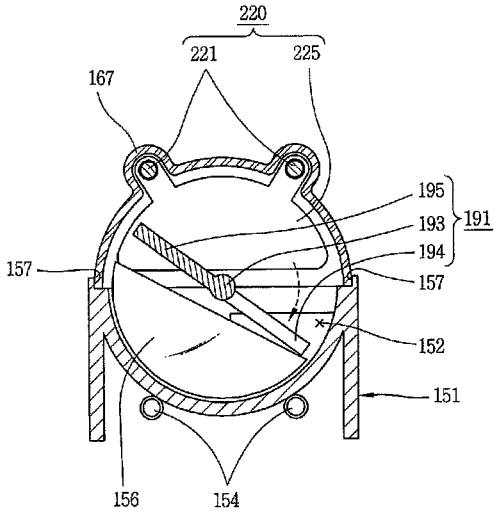
FIGS. 7 and 8 are views illustrating the process of discharging ice in an ice maker in FIG. 6, respectively.

As illustrated in FIG. 7, when the ejector 191 is rotated, each finger 195 enters into the relevant cell 152 to press the ice 156 that has been made within the relevant cell 152 while being rotated. By this, the ice 156 within each cell 152 is removed from an inner wall of the relevant cell 152. The removed ice 156 is guided by the relevant cell 152, an inner surface of the cover 161, and a plate 194 of the ejector 191 while being rotated. More specifically, for the ice 156 removed from the cell 152, the rear side with respect to the rotational direction is supported by the finger 195, and the front side is located with the plate 194, and the outside is blocked by the cover 161, thereby preventing the ice 156 from being entered into the relevant cell 152 again.

Figure 8:
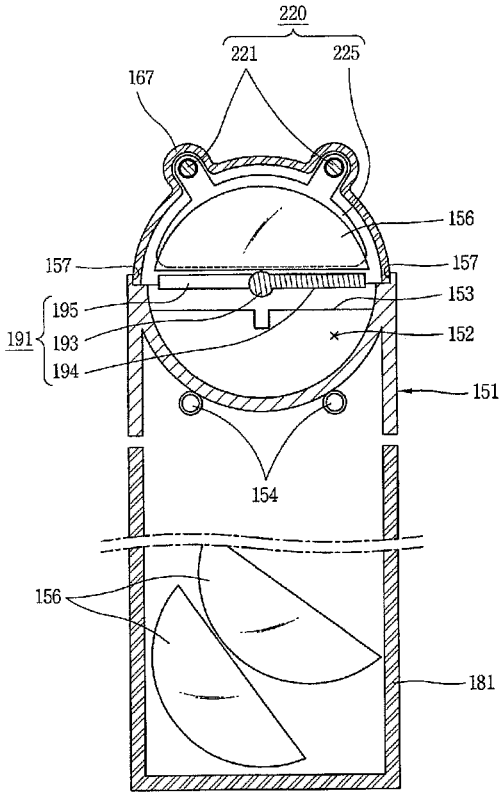

When the ejector 191 is rotated by 180 degrees, as illustrated in FIG. 8, each ice 156 is located at an upper side of the ejector 191, i.e., the finger 195 and plate 194 that have been rotated by 180 degrees.

When the ejector 191 is rotated by 180 degrees, the controller 250 controls the transfer screw driving motor 231 to rotate the transfer screw 221.

When the transfer screw 221 is started to rotate, the pusher 225 is moved from an upper side of the ejector 191 along the transfer screw. By this, the ice 156 placed at an upper side of the ejector 191 is pushed by the pusher 225 to be moved to a side of the ice discharging port 163 and fallen to a lower side of the ice tray 151. The ice 156 moved and fallen by the pusher 225 is stored in the ice bank 181.

When the pusher 225 is moved to an end of the ice tray 151, the controller 250 controls the transfer screw driving motor 231 to rotate the transfer screw 221 in an opposite direction. If the transfer screw 221 is rotated in an opposite direction, then the pusher 225 is moved to an initial position along the transfer screw 221.

When the pusher 225 is moved to an initial position, the controller 250 controls the shaft driving motor 213 to rotate the shaft 193 in an opposite direction. Here, as illustrated in FIG. 10, when the ejector 201 is configured to have a finger 205 protruded at both sides thereof, the shaft driving motor 213 is configured to rotate in a direction, and thus the controller 250 allows the shaft driving motor 213 to wait a next signal.

Hereinafter, another embodiment of the present invention will be described with reference to FIGS. 11 through 22.

Figure 11:
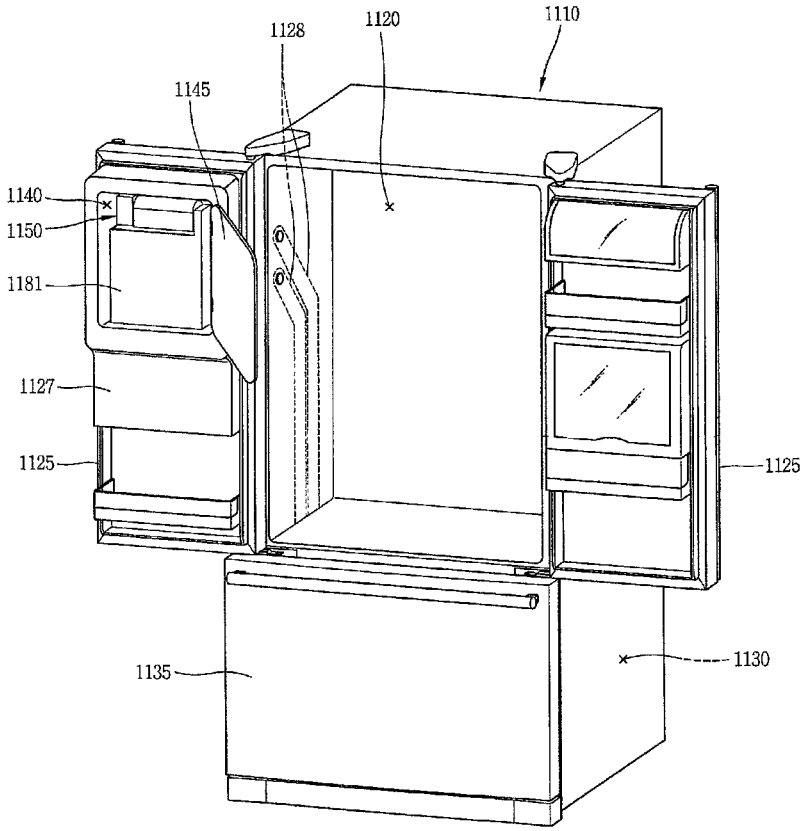
FIG. 11 is a perspective view illustrating a refrigerator according to another embodiment of the present invention.

As illustrated in FIG. 11, the refrigerator may include a refrigerator body 1110 formed with cooling chambers 1120, 1130, doors 1125, 1135 for opening and closing the cooling chambers 1120, 1130, and an ice maker 1150 provided at either one of the refrigerator body 1110 and the doors 1125, 1135.

The refrigerating chamber 1120 may be provided at an upper region of the refrigerator body 1110. A refrigerating chamber door 1125 may be provided at a front surface of the refrigerator body 1110 to open and close the refrigerating chamber 1120. There may be provided a plurality of refrigerating chamber doors 1125. The refrigerating chamber door 1125 may be revolvably combined with the refrigerator body 1110. A dispenser 1127 may be provided at the refrigerating chamber door 1125 to take out water or ice without opening the refrigerating chamber door 1125.

The freezing chamber 1130 may be formed at a lower region of the refrigerator body 1110. A freezing chamber door 1135 may be provided at the freezing chamber 1130 to open and close the freezing chamber 1130. The freezing chamber door 1135 may be slidably provided at the refrigerator body 1110 to be slid forward and backward.

A freezing cycle (not shown) may be provided at the refrigerator body 1110 to cool the freezing chamber 1130 and/or refrigerating chamber 1120. The freezing cycle may include a compressor for compressing refrigerant, a condenser for heat radiating refrigerant, an expansion apparatus for decompressing and expanding refrigerant, and an evaporator for allowing refrigerant to absorb and evaporate surrounding latent heat.

On the other hand, an ice making chamber 1140 may be formed at the refrigerating chamber door 1125. The ice making chamber 1140 may be configured in an openable and closable manner. An opening may be formed at a rear end of the ice making chamber 1140. An ice making chamber door 1145 may be provided at a rear end of the ice making chamber 1140 to open and close the opening of the ice making chamber 1140.

The ice making chamber door 1145 may be revolvably combined with a side of the opening of the ice making chamber 1140. A sidewall cool air duct 1128 may be provided at the refrigerator body 1110 to supply cool air produced in the freezing chamber 1130 to the ice making chamber 1140. There may be provided a plurality of sidewall cool air ducts 1128. It may be configured that cool air is supplied to one of the sidewall cool air ducts 1128 and cool air is returned from the other one thereof.

Figure 12:
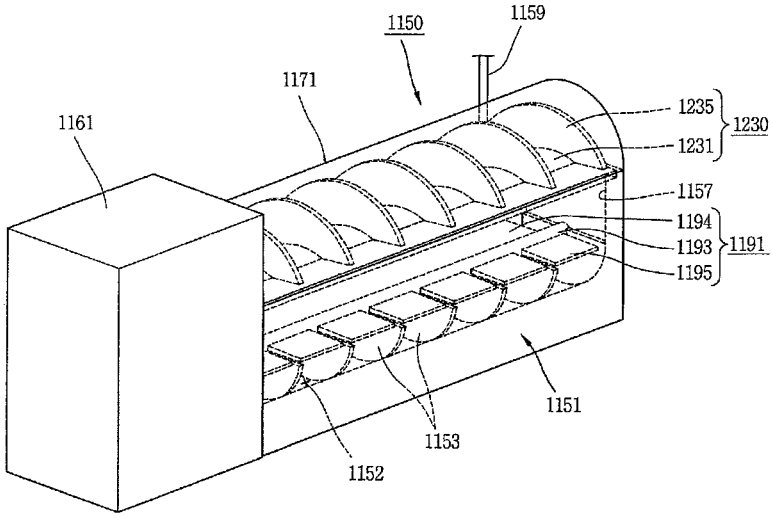
FIG. 12 is a perspective view illustrating an ice maker in FIG. 11.
Figure 13:
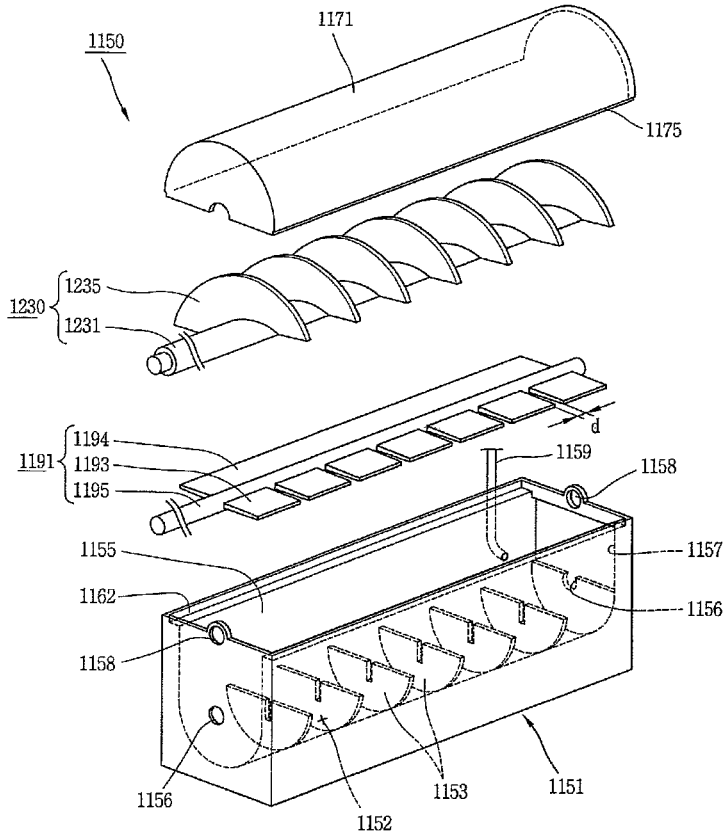
FIG. 13 is a separated perspective view illustrating an ice maker in FIG. 12.
Figure 14:
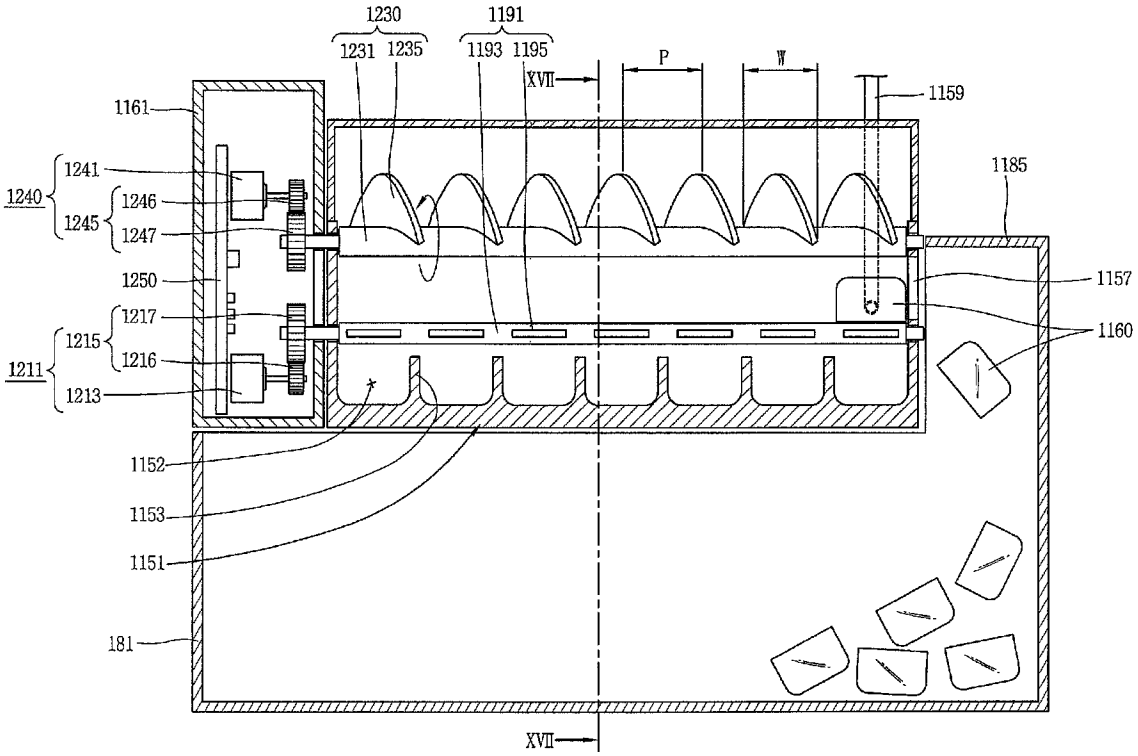
FIG. 14 is a longitudinal cross-sectional view illustrating an ice maker in FIG. 11.
Figure 15:
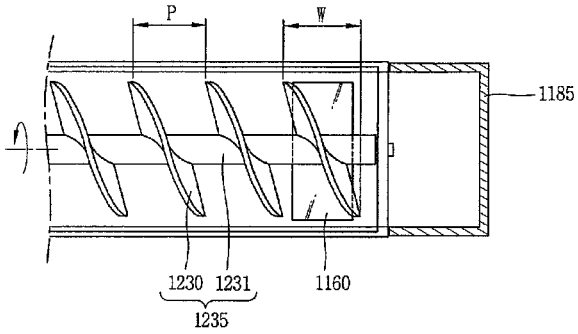
FIG. 15 is a plan view illustrating a transfer unit in FIG. 14.

On the other hand, an ice maker 1150 of the refrigerator may be provided inside the ice making chamber 1140. As illustrated in FIGS. 12 through 14, the ice maker 1150 may include an ice tray 1151 provided with a plurality of cells 1152, an ejector 1191 for removing ice 1160 formed in the cell 1152, and a transfer unit 1230 for transferring the removed ice in the length direction of the ice tray 1151.

An ice bank 1181 may be provided at a lower side of the ice tray 1151 to accommodate and store the ice 1160 that has been made and fallen from the ice tray 1151. The ice bank 1181 may be disposed to be protruded from one side thereof, i.e., a side where the ice 1160 is fallen, along the length direction of the ice tray 1151. By this, the ice bank 1181 may be provided right under the ice tray 1151 and the ice bank 1181 is not required to be protruded in the width direction of the ice tray 1151, thereby reducing the installation width of the ice maker 1150. The ice bank 1181 may be configured with a bowl opened upward.

An ice guide 1185 for guiding the ice 1160 being fallen from the ice tray 1151 to an inner portion of the ice bank 1181 may be provided at a side of the ice bank 1181, as illustrated in FIG. 14. Here, the ice guide 1185 may be formed to be protruded upward at a side of the upper portion of the ice bank 1181. The ice guide 1185 may be integrally configured with the ice bank 1181 when fabricating the ice bank 1181.

The ice tray 1151 may be provided with a plurality of cells 1152 partitioned with one another therein and opened upward. The cross-section of cells 1152 may be configured to have a semi-circular shape. The ice tray 1151 may be formed with a metal member. By this, heat and/or cool air can be rapidly supplied, thereby rapidly removing or making ice.

Figure 17:
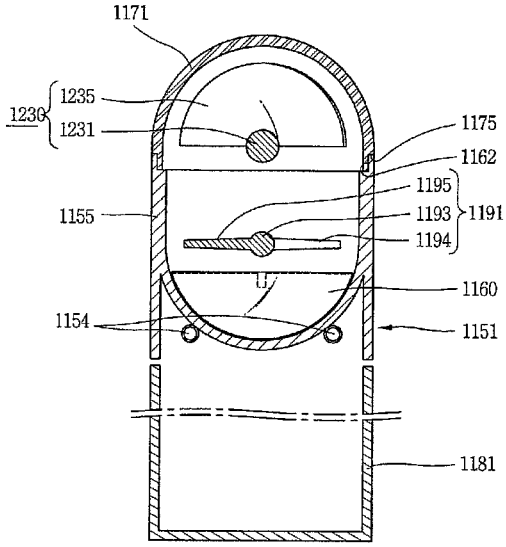
FIG. 17 is a longitudinal cross-sectional view taken along the line X VII-X VII of FIG. 14.

A heater 1154 may be provided in the ice tray 1151 to apply heat to the ice tray 1151 to easily remove the ice. The heater 1154 may be configured with an electric heater 1154 for dissipating heat when power is supplied. The electric heater 1154 may be disposed at a bottom portion of the ice tray 1151 as illustrated in FIG. 17.

A water supply portion 1159 may be provided at a side of the ice tray 1151 to supply water to the cells 1152. The water supply portion 1165 may be configured with a pipe.

The ice tray 1151 may be formed with a sidewall portion 1155 extended by a predetermined height from an upper end of the each cell 1152. By this, it may be possible to suppress water accommodated inside the each cell 1152 from being overflowed to the lateral side thereof.

A cover 1171 may be provided at an upper side of the ice tray 1151 to block an upper opening of the ice tray 1151. By this, water supplied into the ice tray 1151 may be suppressed from being overflowed out of the ice tray 1151 by exerting an external force on it. The cross-section of the cover 1171 may be configured to have a semi-circular shape to form a space portion therein. A lower side of the cover 1171 may be formed to be opened.

A rib 1162 disposed at an outer side of the cover 1171 may be formed at an upper end of the ice tray 1151. More specifically, the rib 1162 may be disposed at an lower outer side of the cover 1171. By this, water in the ice tray 1151 can be effectively suppressed from being overflowed. An engagement portion 1175 may be formed at the cover 1171 to be engaged with the rib 1162. The engagement portion 1175 may be formed to have a staircase cross-sectional shape.

On the other hand, an ejector 1191 may be provided at an upper side of the ice tray 1151 to remove the ice 1160 that has been made within the cell 1152. More specifically, the ejector 1191 may be disposed at an upper side of the cell 1152 of the ice tray 1151.

As illustrated in FIGS. 13 and 14, the ejector 1191 may include a shaft 1193, a plate 1194 protruded from one side of the shaft 1193, a plurality of fingers 1195 protruded in a direction opposite to the plate 1194, and a shaft driving portion 1211 for providing driving power to the shaft 1193.

The shaft 1193 may be disposed along the length direction of the ice tray 1151. The shaft 1193 may be rotatably supported by the ice tray 1151. For this, a shaft supporting portion 1156 may be provided at the ice tray 1151 to rotatably support the shaft 1193.

A plate-shaped plate 1194 protruded outward along a radial direction may be provided at a side of the shaft 1193. A plurality of fingers 1195 protruded along an radial direction and disposed to be apart from one another by a predetermined distance may be provided at the other side of the shaft 1193.

More specifically, the fingers 1195 may be disposed to correspond to each cell 1152 of the ice tray 1151, and may be configured to be rotated by passing through an inner portion of the each cell 1152. The each finger 1195 may be formed to be apart from one another by a predetermined distance (d) to allow the partition 1153 of the relevant cell 1152 to be inserted therein. Here, the plate 1194 and fingers 1195 are protruded in an opposite direction to each other and disposed on the same plane.

The ejector 1191 include a shaft driving portion 1211 for providing a driving force to rotate the shaft 1193. The shaft driving portion 1211 may be provided in the control box 1161. An end of the shaft 1193 may be inserted into the control box 1161 to be rotatably supported.

The shaft driving portion 1211 may include a shaft driving motor 1213 for generating a driving force, and a power transmission means 1215 for transmitting the driving force of the shaft driving motor 1213 to the shaft 1193. The power transmission means 1215 may be configured by including a plurality of gears 1216, 1217 engaged with each other to be rotated. Here, the number of the gears of the power transmission means 1215 may be suitably controlled. The power transmission means may be also configured to transmit power by including a belt and a pulley, or may be configured by including a chain and a chain sprocket wheel, in addition to the plurality of gears. The shaft driving portion 1211 may be configured to be rotated forward or backward.

Figure 22:
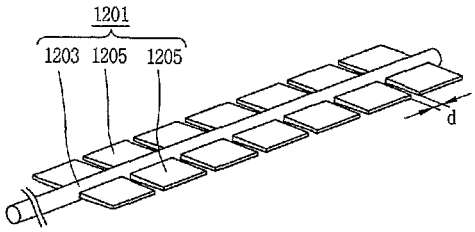
FIG. 22 is a perspective view illustrating a modified example of an ejector in FIG. 13.

Here, as illustrated in FIG. 22, an ejector 1201 may be configured by including a shaft 1203, and a plurality of fingers 1205 protruded in the direction opposite to each other at both sides of the shaft 1203 and disposed to be apart from one another by a predetermined distance. The shaft 1203 may be disposed along the length direction at an upper side of the ice tray 1151. At this time, the shaft driving portion 1211 of the ejector 1201 may be configured to be rotated in any one direction regardless of its forward or backward rotation.

On the other hand, a transfer unit 1230 for transferring the ice 1160 in the length direction of the ice tray 1151 may be provided at an upper side of the ice tray 1151. An ice discharging port 1157 may be provided at a side of the transfer unit 1230 to discharge the transferred ice 1160. The ice discharging port 1157 may be formed at the cover or the ice tray according to the configuration. In this embodiment, the ice discharging port 1157 is formed to be passed through an end of the ice tray.

The transfer unit 1230 may be configured by including a screw shaft 1231; a screw fin 1235 spirally protruded at the screw shaft 1231; and a screw shaft driving unit 1240 for providing a driving force to the screw shaft 1231.

The transfer unit 1230, as illustrated in FIGS. 14 through 17, may be disposed at an upper side of the ejector 1191. More specifically, the screw shaft 1231 may be disposed at an upper side of the ejector 1191 to be apart therefrom by a predetermined height. In other words, the screw shaft 1231 may be disposed to be apart upward from the ejector 1191 with a height difference of more than rotation radius of the screw fin 1235. By this, the ice 1160 removed from each cell 1152 by the ejector 1191 may be disposed at an upper side of the ejector 1191. The transfer unit 1230 may be disposed inside the cover 1171.

The screw shaft 1231 may be configured to be rotatably supported by the ice tray 1151 or the cover 1171. In this embodiment, as illustrated in FIG. 13, a screw shaft supporting portion 1158 for rotatably supporting the screw shaft 1231 is provided at an upper end of the ice tray 1151.

A plurality of screw fins 1235 may be provided at an outer surface of the screw shaft 1231 to transfer the ice 1160 in an axial direction.

The screw fins 1235 may be disposed at the screw shaft 1231 to be inclined to have a predetermined pitch (P). Here, the pitch (P) of the screw fins 1235 may be formed to correspond to the size of the cell 1152 of the ice tray 1151.

The screw fin 1235 may be formed in a semi-circular shape. By this, the ice 1160 removed from the relevant cell 1152 by the ejector 1191 to be moved in an upper direction of the ejector 1191 may be placed at an upper side of the ejector 1191 without interfering with the screw fin 1235.

Figure 16:
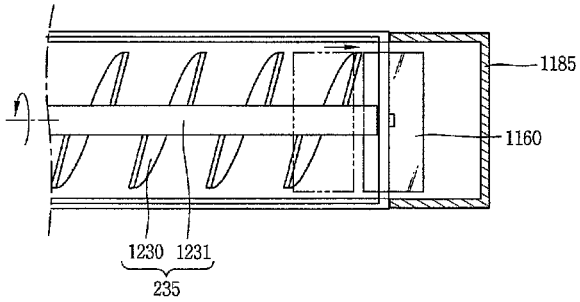
FIG. 16 is a plan view illustrating a rotation state in FIG. 15.

The width (W) between the front and rear ends along a rotational direction of the screw fin 1235 may be formed equal to or slightly larger than the pitch (P) of the screw fin 1235. By this, when the screw shaft 1231 is rotated once, as illustrated in FIG. 16, the ice 1160 is moved by the pitch (P) of the screw fin 1235. When the screw shaft 1231 is continuously rotated, each ice 1160 is moved by one pitch (P) by each screw fin 1235 and sequentially discharged through the ice discharging port 1157.

On the other hand, the screw shaft driving unit 1240 may be provided in the control box 1161. An end of the screw shaft 1231 may be inserted into the control box 1161 to be rotatably supported. The screw shaft driving unit 1240 may include a screw shaft driving motor 1241 for generating a driving force, and a power transmission means 1245 for transmitting the driving force of the screw shaft driving motor 1241 to the screw shaft 1231. The power transmission means 1245 may be configured by including a plurality of gears 1246, 1247 engaged with each other to be rotated. Here, the number of the gears of the power transmission means 1245 may be suitably controlled. The power transmission means may be also configured to transmit power by including a belt and a pulley, or may be configured by including a chain and a chain sprocket wheel.

On the other hand, the ice maker 1150 may be configured by including a controller 1250 having a control program. The controller 1250 may be implemented by PCB as illustrated in FIG. 14. The controller 1250 may be provided with a mode selection unit 1251 to select an operation mode such as an ice-making mode. The controller 1250 may be controllably connected to a shaft driving motor 1213, an electric heater 1154, and a screw shaft driving motor 1241, respectively, to control the process of making and removing ice when selecting an ice-making mode.

By such a configuration, when an ice-making mode is selected by the mode selection unit 1251, water is supplied to the ice tray 1151 through the water supply portion 1159. When a predetermined time has passed after supplying water, the ice 1160 is formed within the ice tray 1151 as illustrated in FIG. 17. If water within the ice tray 1151 is frozen to form the ice 1160, then the controller 1250 applies power to the electric heater 1154. If power is applied to the electric heater 1154, then a boundary surface of the ice 1160 contacted with an inner wall of the cell 1152 of the ice tray 1151 is dissolved.

If it reaches a temperature or time at which a surface of the ice 1160 within the each cell 1152 is to be dissolved, then the controller 1250 controls the shaft driving motor 1213 to rotate the ejector 1191.

Figure 18:
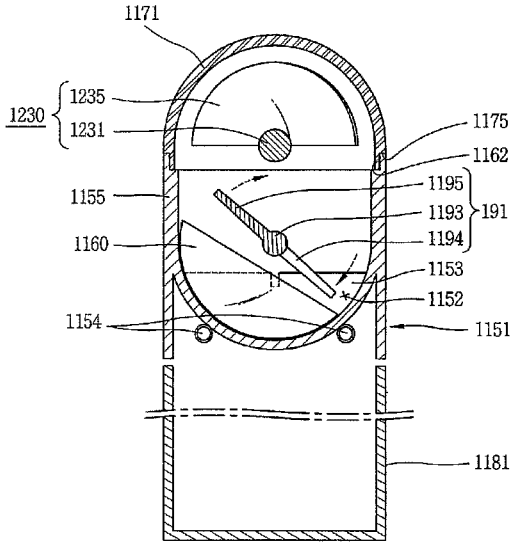
FIGS. 18 through 20 are views illustrating the operation of an ejector in FIG. 17, respectively.

As illustrated in FIG. 18, when the ejector 191 is rotated, each finger 1195 enters into the relevant cell 1152 to press the ice 1160 that has been made within the relevant cell 1152 while being rotated. By this, the ice 1160 within each cell 1152 is removed from an inner wall of the relevant cell 1152.

The removed ice 1160 is guided by the relevant cell 1152, an inner surface of the cover 1171, and a plate 1194 of the ejector 1191 while being rotated. More specifically, for the ice 1160 removed from the cell 1152, the rear side with respect to the rotational direction is supported by the finger 1195, and the front side is located with the plate 1194, and the outside is blocked by the cover 1171, thereby preventing the ice 1160 from being entered into the relevant cell 1152 again.

Figure 19:
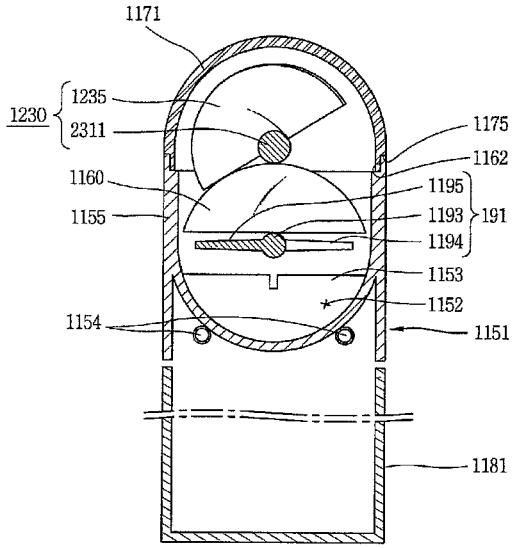
Figure 20:
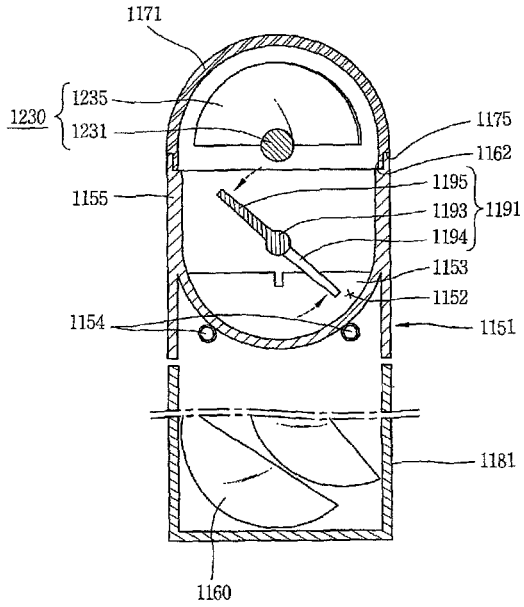
Figure 21:
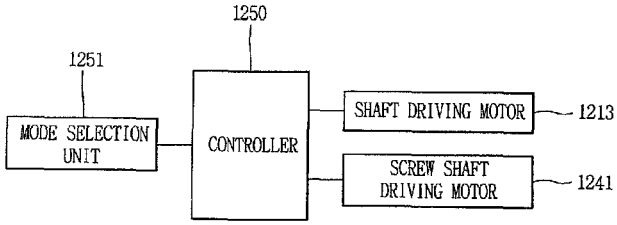
FIG. 21 is a control block diagram illustrating an ice maker in FIG. 11.

When the ejector 1191 is rotated by 180 degrees, as illustrated in FIG. 19, each ice 1160 is located at an upper side of the ejector 1191, i.e., the finger 1195 and plate 1194 that have been rotated by 180 degrees.

When the ejector 191 is rotated by 180 degrees, the controller 1250 controls the screw shaft driving motor 1241 to rotate the screw shaft 1231.

When the screw shaft 1231 is started to rotate, the each screw fin 1235 is rotated, and a front end of each screw fin 1235 presses a side of the ice 1160 placed at an upper surface of the ejector 1191 while being rotated. Accordingly, the each ice 1160 is moved in an axial direction of the screw shaft 1231. When the screw shaft 1231 is rotated once, the each ice 1160 is moved by the pitch (P) of the screw fin 1235. When the screw shaft 1231 is continuously rotated, the ice 1160 is continuously discharged through the ice discharging port 1157. The ice 1160 discharged through the ice discharging port 1157 is accommodated and stored in the ice bank 1181.

On the other hand, when the discharge of the ice 1160 is completed, the controller 1250 controls the screw shaft driving motor 1241 to be (initially) located at an upper side of the screw fin 1235. Next, the controller 1250 controls the shaft driving motor 1213 to rotate the ejector 1191 to be restored to an initial location.

Hereinafter, another embodiment of the present invention will be described with reference to FIGS. 23 through 30.

Figure 23:
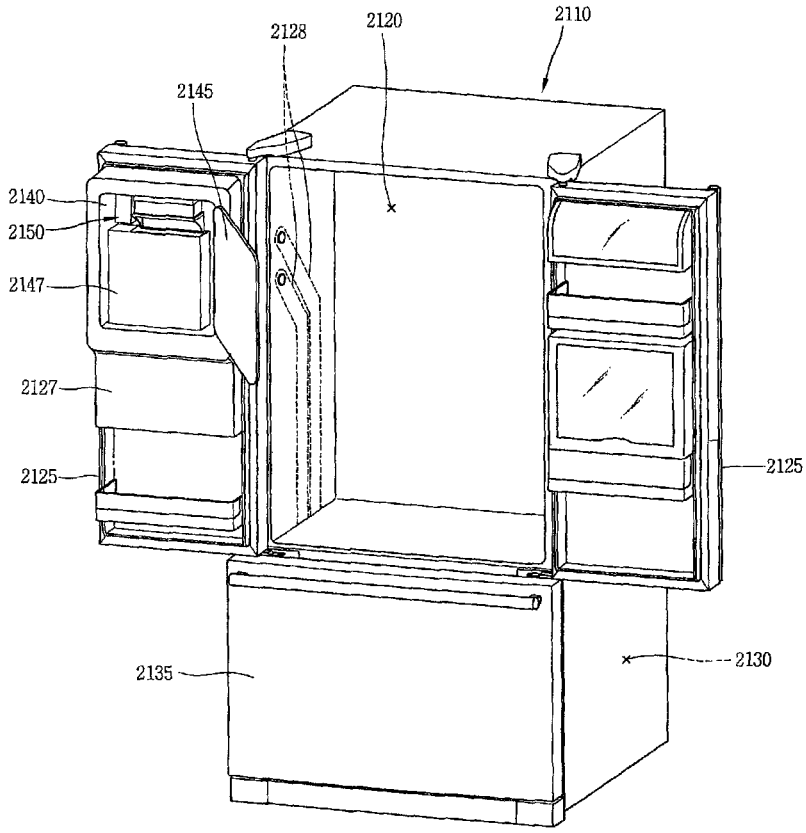
FIG. 23 is a perspective view illustrating a refrigerator having an ice maker according to still another embodiment of the present invention.

As illustrated in FIG. 23, a refrigerator having the ice maker may include a refrigerator body 2110 formed with cooling chambers 2120, 2130, doors 2125, 2135 for opening and closing the cooling chambers 2120, 2130, and an ice maker 2150 for making ice.

The refrigerating chamber 2120 may be provided at an upper region of the refrigerator body 2110, and the freezing chamber 2130 may be provided at a lower portion thereof. The refrigerator body 2110 may be provided with a freezing cycle (not shown) for providing cool air to the refrigerating chamber 2120 and the freezing chamber 2130.

A refrigerating chamber door 2125 may be provided at a front surface of the refrigerator body 2110 to open and close the refrigerating chamber 2120. There may be provided a plurality of refrigerating chamber doors 2125. The refrigerating chamber door 2125 may be revolvably combined with the refrigerator body 2110.

A freezing chamber door 2135 may be provided at a front surface of the freezing chamber 2130 to open and close the freezing chamber 2130. The freezing chamber door 2135 may be configured to be slid forward or backward.

A dispenser 2127 may be provided at, at least, one of the refrigerating chamber doors 2125 to take out water and/or ice without opening the refrigerating chamber door 2125.

An ice making chamber 2140 for making ice 2153 may be formed at the refrigerating chamber door 2125. A sidewall cool air duct 2128 buried in the sidewall may be provided at the refrigerator body 2110 to provide cool air produced in the freezing chamber 2130 to the ice making chamber 2140. The ice making chamber 2140 may be configured in an openable and closable manner. An ice making chamber door 2145 may be provided at a side of the opening of the ice making chamber 2140 to open and close the ice making chamber 2140.

An ice maker 2150 may be provided inside the ice making chamber 2140. An ice bank 2147 may be provided at a lower side of the ice maker 2150 to accommodate the ice 2153 that has been made and fallen from the ice maker 2150.

Figure 24:
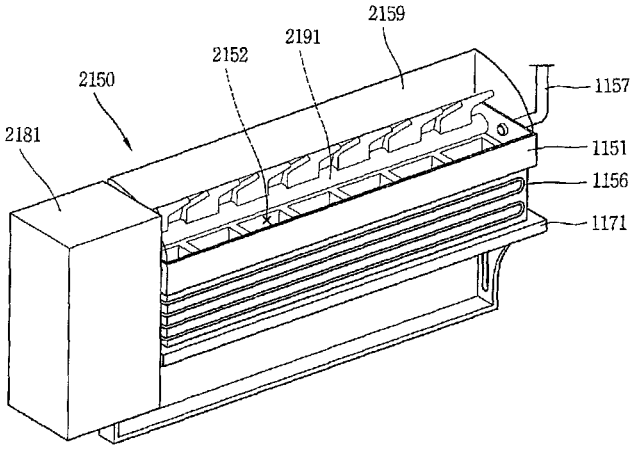
FIG. 24 is a perspective view illustrating an ice maker in FIG. 23.
Figure 25:
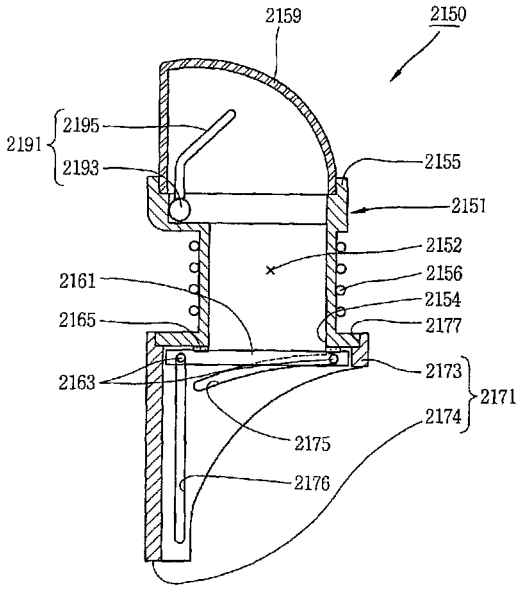
FIG. 25 is a longitudinal cross-sectional view illustrating an ice maker in FIG. 24.

As illustrated in FIGS. 24 and 25, the ice maker 2150 may include an ice tray 2151 having a plurality of cells 2152 provided with a discharge port 2154 at the bottom portion, a damper 2161 configured to open and close the discharge port 2154, and a damper driving unit 2200 for driving the damper 2161. A control box 2181 may be provided at a side of the ice tray 2151.

The ice bank 2147 may have a substantially same sized thickness (width) as the thickness (width) of the ice tray 2151 and disposed right under the ice tray 2151. By this, the ice tray 2151 and ice bank 2147 have a relatively low thickness (width) not to be protruded from the refrigerating chamber 2120, thereby more extensively utilizing the space in the refrigerator.

The ice tray 2151 may be formed with a metal member. The ice tray 2151 may be provided with a heater 2156 to apply heat to the ice tray 2151. The heater 2156 may be implemented by an electric heater 2156 for dissipating heat when power is applied thereto. By this, the heat transfer speed of the ice tray 2151 is increased, thereby rapidly making and removing ice. Here, the making ice means that water is frozen to the ice 2153 inside the ice tray 2151, and the removing ice means that the ice 2153 is removed from the ice tray 2151.

The electric heater 2156 may be provided at a lateral surface of the ice tray 2151. The electric heater 2156 may be also disposed at both lateral surfaces of the ice tray 2151.

A plurality of cells 2152 having a cubic shape are provided in the ice tray 2151. The cells 2151 may be formed to be separated from one another by a partition. By this, it may be possible to make a plurality of ices 2153 (ice cubes) having a hexahedral shape. A discharge port 2154 is formed at the bottom portion of the each cell 2152 to discharge the ice 2153. By this, the ice 2153 formed within the each cell 2152 may be discharged to a lower side thereof.

A cover 2159 may be provided at an upper side of the ice tray 2151 to block an upper opening of the ice tray 2151. By this, when the refrigerating chamber door 2125 is opened or closed in a state that water is supplied into the each cell 2152, water within the ice tray 2151 may be prevented from being overflowed out of the ice tray 2151 by an external force transferred to the ice tray 2151.

A protruded sill 2155 may be provided at an upper end of the ice tray 2151 to be disposed at an outside of the cover 2159. The sill 2155 is extended along the circumference of the ice tray 2151. By this, water may be more effectively prevented from being overflowed out of the ice tray 2151.

A water supply portion 2157 may be provided at a side of the cover 2159 to supply water into the ice tray 2151. The water supply portion 2157 may be configured with a pipe.

An ejector 2191 may be provided at an upper side of the ice tray 2151 to press and remove the ice 2153 that has been formed in the cell 2152. The ejector 2191 may include a shaft 2193, and a plurality of fingers 2195 protruded at the shaft 2193 along a radial direction. The shaft 2193 may be disposed along the length direction of the ice tray 2151. The fingers 2195 may be configured such that the end thereof is bent downward. By this, the ice 2153 of the ice tray 2151 can be more effectively pressed downward.

The ejector 2191 may include an ejector driving portion for providing a driving force to the shaft 2193. The ejector driving portion may be provided with an ejector driving motor. The ejector driving motor may be disposed in the control box 2181. The shaft 2193 may be extended into the control box 2181 to be rotatably supported. A power transmission means (not shown) may be provided between the ejector driving motor and the ejector 2191 to transmit a rotational force of the ejector driving motor to the shaft 2193. The power transmission means (not shown) may be configured to have a plurality of gears.

Figure 28:
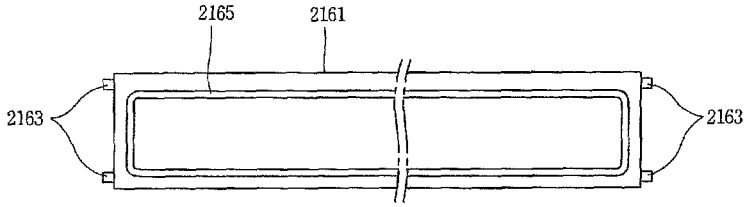
FIG. 28 is a plan view illustrating a damper in FIG. 24.
Figure 29:
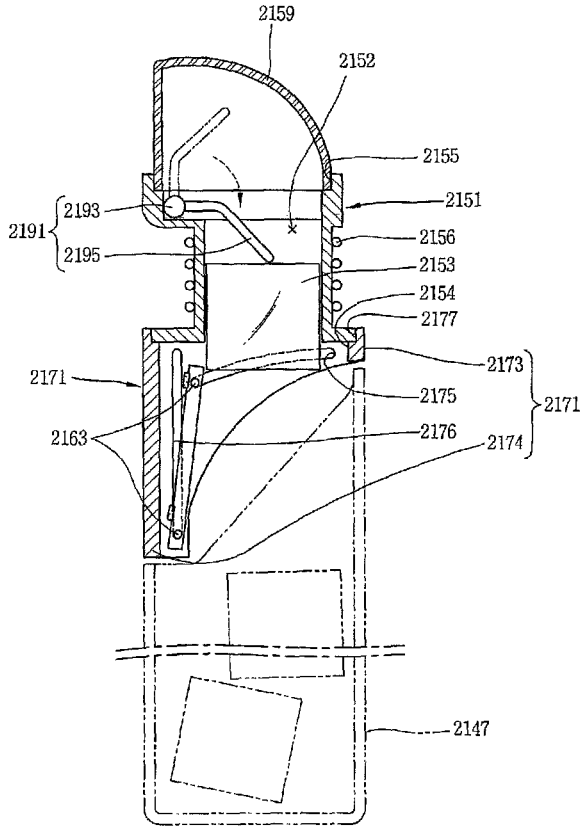
FIG. 29 is a cross-sectional view illustrating the process of discharging ice in an ice maker of FIG. 24.

On the other hand, a damper 2161 may be provided at a lower side of the ice tray 2151 to open and close a discharge port 2154 of the each cell 2152. When the discharge port 2154 is blocked, the damper 2161 cooperated with the ice tray accommodates water to form a space in which the ice 2153 is formed. The damper 2161, as illustrated in FIG. 28, may be formed in a long plate shape (rectangular plate shape) to open and close the discharge port 2154 of the each cell 2152 at the same time. The reciprocal contact region of the damper 2161 and the ice tray 2151 may be provided with a sealing member 2165 to suppress the leakage of water. The sealing member 2165 may be composed of silicon resin. The sealing member 2165 may be configured in a closed-loop shape. For example, the sealing member 2165 may be fixed and combined with an upper surface of the damper 2161.

The damper 2161 may be configured to open and close the discharge port 2154 while one side thereof moves horizontally and the other side thereof moves vertically. The protrusions 2163 protruded outward, respectively, may be provided at both ends of the damper 2161 along a length direction thereof. A damper guide 2171 may be provided at a lower side of the ice tray 2151 to guide the movement of the damper 2161.

Figure 26:
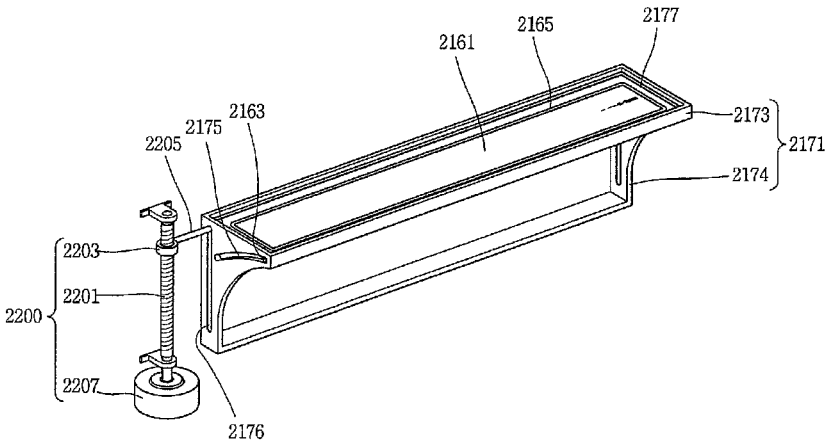
FIG. 26 is a perspective view illustrating a damper guide and a damper driving unit of an ice maker in FIG. 24.
Figure 27:
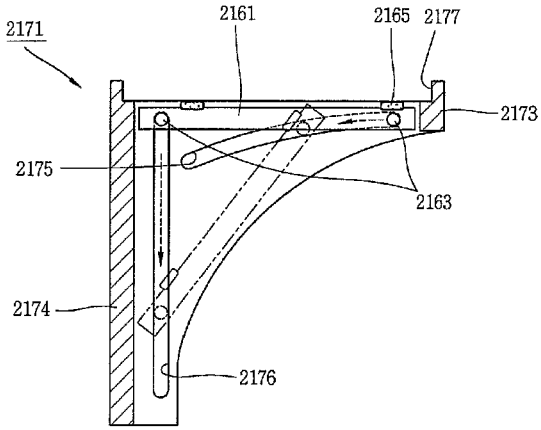
FIG. 27 is a view illustrating the lifting operation of a damper in FIG. 24.

As illustrated in FIGS. 25 and 26, the damper guide 2171 may include a horizontal portion 2173 horizontally disposed at a lower side of the ice tray 2151 and a vertical portion 2174 extended downward at a lower side of the horizontal portion 2173. A landing portion 2177 may be formed at an upper side of the horizontal portion 2173, thereby allowing a lower end of the ice tray 2151 to be landed thereon. A space is formed at an inner side of the landing portion 2177 to accommodate the damper 2161.

A horizontal slot 2175 may be provided at the horizontal portion 2173 to accommodate and guide a protrusion of the damper 2161. A vertical slot 2176 may be provided at the vertical portion 2174 to accommodate and guide a protrusion of the damper 2161. More specifically, it may be configured such that two front-sided protrusions 2163 of the damper 2161 in the drawing are accommodated in the horizontal slot 2175, respectively, and two rear-sided protrusions 2163 of the damper 2161 are accommodated in the vertical slot 2176, respectively. Here, the horizontal slot 2175 may be configured in a curved form, and the vertical slot 2176 may be configured in a linear form.

A damper driving unit 2200 for driving the damper 2161 to open and close the discharge port 2154 of the ice tray 2151 may be provided at a side of the damper 2161. The damper driving unit 2200 may be configured to be operated by electricity (electric current). For example, the damper driving unit 2200 may include a lead screw 2201, a female screw member 2203 screw-combined with the lead screw 2201 to be relatively moved, and a lead screw driving portion 2207 for providing a driving force to the lead screw 2201 to drive the damper 2161. The lead screw driving portion 2207 may be configured with a lead screw driving motor 2207.

The damper driving unit 2200 may be disposed within the control box 2181. The lead screw 2201 may be disposed in a vertical direction. By this, the female screw member 2203 may be vertically moved according to the forward or backward rotation of the lead screw 2201. The female screw member 2203 may be configured to be connected to the damper 2161. A connecting portion 2205 may be provided at the female screw member 2203 to be connected to a protrusion of the damper 2161. Here, the connecting portion 2205 may be configured such that the protrusion is inserted by a predetermined depth, and on the contrary, an end of the connecting portion 2205 is inserted by a predetermined depth into a protrusion of the damper 2161. A through hole having a long length along the vertical direction may be formed at the control box 2181 to correspond to a lifting trajectory of the connecting portion 2205.

Figure 30:
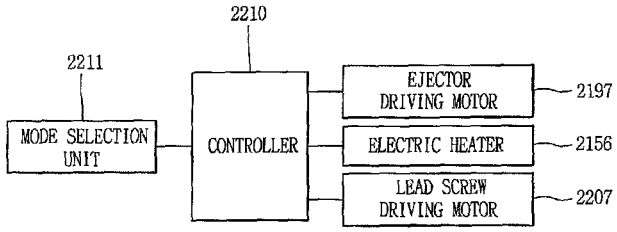
FIG. 30 is a control block diagram illustrating an ice maker in FIG. 22.

On the other hand, as illustrated in FIG. 30, the ice maker 2150 may be provided with a controller 2210 having a control program. The controller 2210 may be configured in a PCB form. The controller 2210 may be disposed inside the control box 2181. The controller 2210 may be connected to a mode selection unit 2211 to select an operation mode such as an ice-making mode. The controller 2210 may be controllably connected to a ejector driving motor 2197, an electric heater 2156, and a lead screw driving motor 2207, respectively, to suitably control the process of making and removing ice.

By such a configuration, when an ice-making mode is selected by the mode selection unit 2211, the controller 2210 check whether the discharge port 2154 is blocked by the damper 2161. If the discharge port 2154 is blocked by the damper 2161, then the controller 2210 controls the lead screw driving portion 220 to allow the damper 2161 to block the discharge port 2154.

The discharge port 2154 is blocked, and water is supplied to each cell 2152 of the ice tray 2151, and a predetermined time (ice making time) is passed. If the predetermined time is passed, then the controller 2210 applies power to the electric heater 2156. The ice tray 2151 is heated by the electric heater 2156, and a boundary region of the ice 2153 frozen on a surface of the each cell 2152 is dissolved.

If it reaches a temperature at which a surface of the ice 2153 within the each cell 2152 is to be dissolved or a predetermined time is passed, then the controller 250 controls the lead screw driving portion 220, thereby allowing the damper 2161 to open the discharge port 2154. In other words, the lead screw driving portion 220 is controlled to be rotated in the direction of lowering the female screw member 2203. If the female screw member 2203 is lowered, then a side of the damper 2161 is lowered along the vertical slot 2176, and at the almost same time, the other side of the damper 2161 is moved backward along the horizontal slot 2175. By this, the discharge port 2154 can be opened.

If the discharge port 2154 is opened by the damper 2161, then the controller 2210 controls the ejector driving motor 2197 to allow the finger 2195 of the ejector 2191 to be rotated downward. The each finger 2195 presses an upper surface of the ice 2153 that has been made within the cell 2152 while being rotated downward, thereby allowing the ice 2153 to be fallen through the discharge port 2154. The fallen ice 2153 is accommodated into the ice bank 2147.

If the discharge of the ice 2153 is completed, then the controller 2210 may control the ejector driving motor 2197 to allow the ejector 2191 to be revolved upward, and control the lead screw driving portion 2207 to allow the damper 2161 to block the discharge port 2154 of the ice tray 2151.

Hereinafter, still another embodiment of the present invention will be described with reference to FIGS. 31 through 34. The same or similar elements to those of the foregoing configuration are designated with the same numeral references in the drawings and their redundant description will be omitted.

Figure 31:
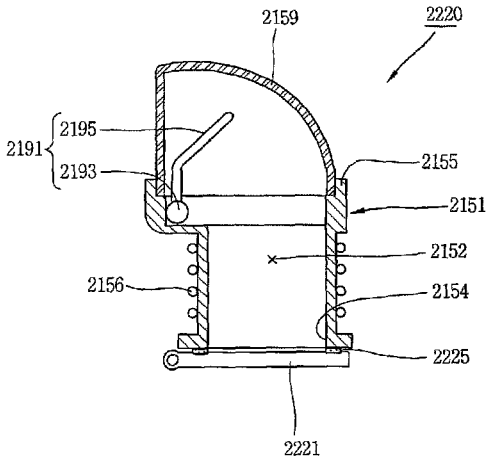
FIG. 31 is a longitudinal cross-sectional view illustrating an ice maker in a refrigerator according to still another embodiment of the present invention.

As illustrated in FIG. 31, an ice maker 2220 of the refrigerator may include an ice tray 2151 having a plurality of cells 2152 provided with a discharge port 2154 at the bottom portion, a damper 2161 configured to open and close the discharge port 2154, and a damper driving unit 2230 for driving the damper 2221.

The ice tray 2151 may be formed with a metal member. By this, the heat transfer speed of the ice tray 2151 may be increased. An electric heater 2156 may be provided at an outer lateral side of the ice tray 2151 to apply heat to the ice tray 2151. By this, rapidly making and removing ice is possible.

The ice tray 2151 may be formed in a substantially hexahedral shape that is opened upward. A cover 2159 may be provided at an upper side of the ice tray 2151 to block an upper side of the ice tray 2151. By this, water within the ice tray 2151 may be prevented from being overflowed. A sill 2155 may be formed to be disposed at a circumference of the cover 2159. By this, water overflow may be more effectively prevented.

An ejector 2191 may be provided at an upper side of the ice tray 2151. The ejector 2191 may include a shaft 2193, and a plurality of fingers 2195 protruded in a radial direction. The end of fingers 2195 may be bent. By this, the ice 2153 of the ice tray 2151 can be more effectively pressed downward. The shaft 2193 may be inserted into the control box 2181 to be rotatably supported. An ejector driving portion for driving the ejector 2191 may be provided inside the control box 2181.

On the other hand, the damper 2221 may be formed with a plate-shaped member. The damper 2221 may be formed in a rectangular plate shape. The damper 2221 may be provided with a sealing member 2225 contacted with the bottom portion of the ice tray 2151 to maintain airtightness. At least one end of the damper 2221 may be provided with a rotational axis to be extended in the length direction. By this, the damper 2221 is rotated by using a long side thereof as a rotational axis line, thereby reducing the rotational radius of the damper 2221. The rotational axis may be inserted into the control box 2181 to be rotatably supported. A damper driving unit 2230 may be provided at a side of the rotational axis to revolvably drive the damper 2221. The damper driving unit 2230 may be provided inside the control box 2181.

Figure 32:
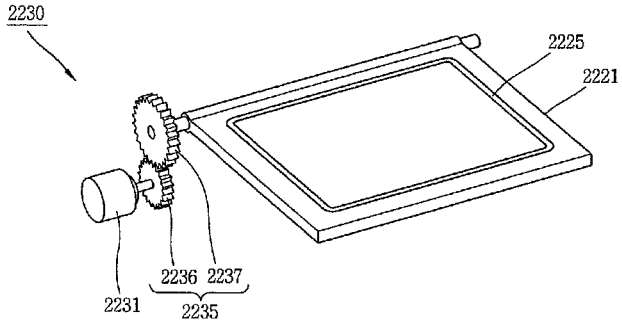
FIG. 32 is a perspective view illustrating a damper driving unit in an ice maker of the FIG. 31.
Figure 33:
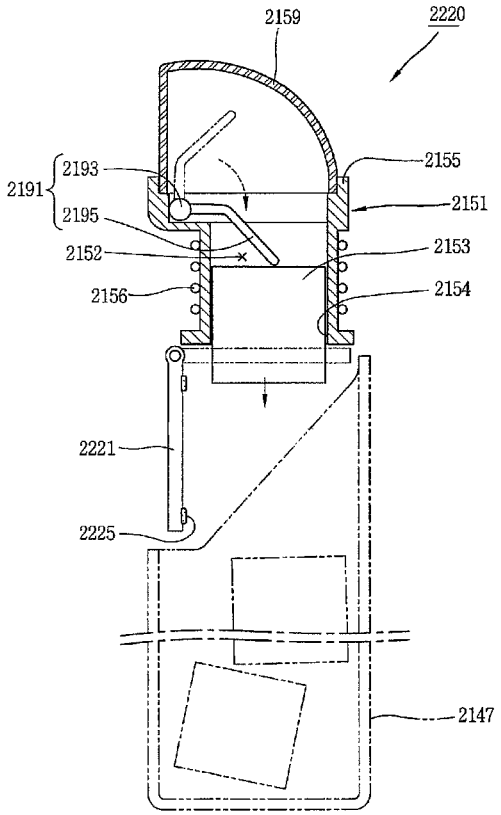
FIG. 33 is a view illustrating the process of discharging ice in an ice maker of FIG. 31.

The damper driving unit 2230, as illustrated in FIG. 32, may include a damper driving motor 2231 for generating a driving force, and a power transmission means 2235 for transmitting the driving force of the damper driving motor 2231 to the shaft 2193. The power transmission means 2235 may be configured by including a plurality of gears 2236, 2237. For example, the power transmission means 2235 may include a driving gear 2236 provided at the rotational axis of the damper driving motor 2231, and a power transmission gear 2237 provided at the shaft 2193 to be engaged and rotated with the driving gear 2236. The number of the gears of the power transmission means 2235 may be suitably controlled.

Figure 34:
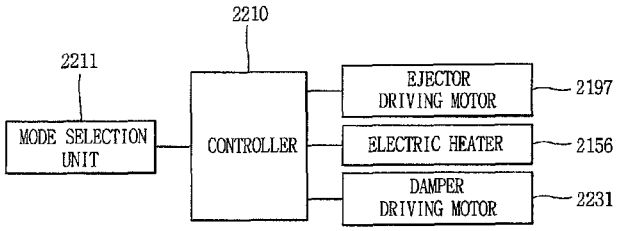
FIG. 34 is a control block diagram illustrating an ice maker in FIG. 31.

As illustrated in FIG. 34, an ice maker 2220 of the refrigerator may be provided with a controller 2210 having a control program. The controller 2210 may be controllably connected to a mode selection unit 2211 for selecting a mode such as an ice-removing mode, and an ejector driving motor 2197 and a damper driving motor 2231 for controlling the process of making and removing ice, respectively.

By such a configuration, when an ice-making mode is selected by the mode selection unit 2211, the controller 2210 check whether the discharge port 2154 is blocked by the damper 2221. If water is supplied into the ice tray 2151 and a predetermined time is passed to complete the process of making ice at a state that the discharge port 2154 is blocked, then the controller 2210 applies power to the electric heater 2156.

Next, the damper 2221 controls the damper driving motor 2231 to open the discharge port 2154. If the discharge port 2154 is opened, then the ejector driving motor 2197 is controlled to allow the finger 2195 to be revolved downward. The finger 2195 is revolved downward, thereby pressing the ice 2153 within the each cell 2152 downward. By this, the ice 2153 within the each cell 2152 is discharged through the discharge port 2154 to be accommodated into the ice bank 2147. If the discharge of the ice 2153 is completed, then the controller 2210 may control the ejector 2191 to be revolved upward, as well as control the damper 2221 to be revolved upward, thereby allowing the discharge port 2154 to be blocked.

Hereinafter, still another embodiment of the present invention will be described with reference to FIGS. 35 through 38.

Figure 35:
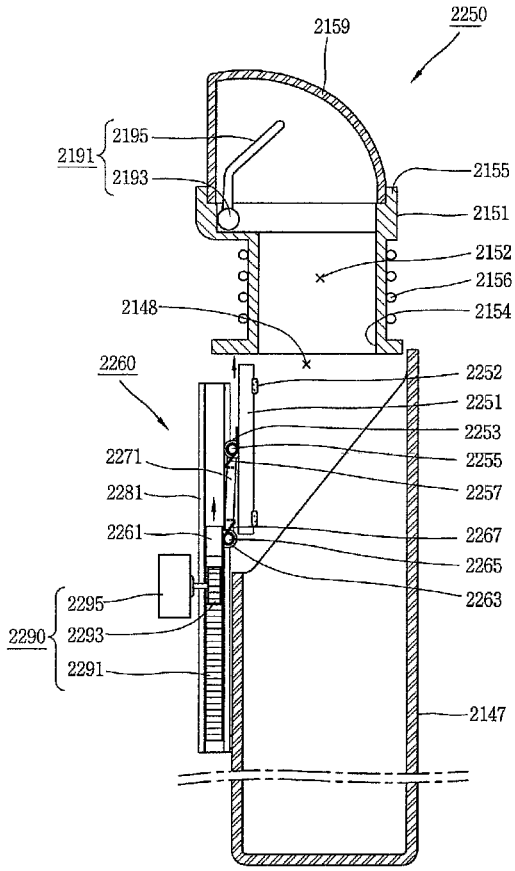
FIG. 35 is a longitudinal cross-sectional view illustrating an ice maker in a refrigerator according to still another embodiment of the present invention.

As illustrated in FIG. 35, an ice maker 2250 of the refrigerator may include an ice tray 2151 having a plurality of cells 2152 provided with a discharge port 2154 at the bottom portion, a damper 2251 for opening and closing the discharge port 2154, and a damper driving unit 2260 for driving the damper 2251.

The ice tray 2151 may be formed with a metal member. An electric heater 2156 may be provided at an outer lateral side of the ice tray 2151 to apply heat to the ice tray 2151.

The ice tray 2151 may be formed in a substantially hexahedral shape opened upward. A cover 2159 may be provided at an upper side of the ice tray 2151 to block an upper side of the ice tray 2151.

An ejector 2191 may be provided at an upper side of the ice tray 2151. The ejector 2191 may include a shaft 2193, and a plurality of fingers 2195 protruded in a radial direction. The shaft 2193 may be inserted into the control box 2181 to be rotatably supported.

The damper 2251 may be formed with a plate-shaped member. The damper 2251 may be formed in a rectangular plate shape. The damper 2251 may be provided with a sealing member 2252 when contacted with the bottom portion of the ice tray 2151, thereby preventing the leakage of water.

A damper driving unit 2260 may be provided at a side of the damper 2251 to drive the damper 2251 to open and close the discharge port 2154. The damper driving unit 2260 may include a lifting member 2261 for moving upward and downward; a connecting member 2271 for connecting the lifting member 2261 to the damper 2251; and elastic members 2257, 2267 for applying an elastic force to allow the lifting member 2261 and the connecting member 2271 to be disposed in a vertical direction, respectively.

The lifting member 2261 may be provided at a lower side of the ice tray 2151. The damper driving unit 2260 may further include a guide member 2281 for guiding the lift of the lifting member 2261. The guide member 2281 may be disposed at a lower side of the ice tray 2151 along a vertical direction. Both ends of the lifting member 2261 may be slidably accommodated and combined with the guide member 2281.

The connecting member 2271 for connecting the damper 2251 to the lifting member 2261 may be provided at a side of the lifting member 2261. A connecting member supporting portion 2263 may be formed at the lifting member 2261 to revolvably support an end of the connecting member 2271. The connecting member 2271 may be revolvably combined with the connecting member supporting portion 2263 around the revolving pin 2265.

A connecting member spring 2267, as an elastic member for applying an elastic force to the connecting member 2271 to be revolved upward, may be provided at the lifting member 2261. The connecting member spring 2267 may be configured with a torsion coil spring. The connecting member spring 2267 may be combined with a circumference of the revolving pin 2265. More specifically, the connecting member spring 2267 may be contacted with the connecting member 2271 such that one end thereof is contacted with the lifting member 2261 to be supported and the other end thereof applies an elastic force to the connecting member 2271 to be revolved upward in the drawing.

The other end (an upper end in the drawing) of the connecting member 2271 may be connected to the damper 2251. A connecting member combining portion 2253 may be provided at the damper 2251 to be relatively and revolvably combined with the other end of the connecting member 2271. An upper end of the connecting member 2271 may be relatively and revolvably combined with the connecting member combining portion 2253 around the revolving pin 2255.

A damper spring 2257, as an elastic member for applying an elastic force to the damper 2251 to be disposed in a vertical direction, may be provided at the connecting member combining portion 2253. The damper spring 2257 may be configured with a torsion coil spring. More specifically, the damper spring 2257 may be combined with a circumference of the revolving pin 2255, and may be contacted with the damper 2251 such that one end thereof may be contacted with the connecting member 2271 and the other end thereof applies an elastic force to the damper 2251 to be disposed in a vertical direction.

On the other hand, the damper driving unit 2260 may further include a lifting member driving portion 2290 for driving the lifting member 2261 upward and downward. The lifting member driving portion 2290 may include a latch-shaped portion 2291 connected to the lifting member 2261, a pinion 2293 engaged and rotated with the latch-shaped portion 2291, and a pinion driving motor 2295 for rotating the pinion 2293. Here, the lifting member driving portion may be also configured with a solenoid, a thermal actuator, or the like.

The latch-shaped portion 2291 may be formed to be extended at a side of the lifting member 2261. In this embodiment, it is shown that the latch-shaped portion 2291 is formed to be extended downward at a lower side of the lifting member 2261. Like the lifting member 2261, the latch-shaped portion 2291 may be slidably accommodated and combined with the guide member 2281. The pinion driving motor 2295 may be provided at a side of the guide member 2281. The pinion 2293 may be provided at a rotational axis of the pinion driving motor 2295. The pinion 2293 is engaged with the latch-shaped portion 2291 to be rotated forward or backward, thereby vertically moving the latch-shaped portion 2291, and thus the lifting member 2261 can be lifted up and down.

An ice bank 2147 may be provided at a side of the lifting member driving portion 2290 to store the ice 2153 that has been made and fallen from the ice tray 2151. A space portion 2148 formed by cutting a side thereof may be provided at an upper region of the ice bank 2147 not to create interference during the movement of the damper 2251 and connecting member 2271.

Figure 38:
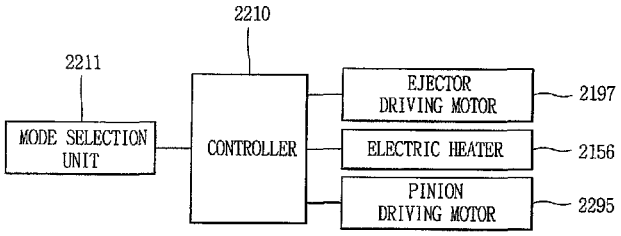
FIG. 38 is a control block diagram illustrating an ice maker in FIG. 35.

As illustrated in FIG. 38, an ice maker 2250 of the refrigerator may be provided with a controller 2210 having a control program. The controller 2210 may be controllably connected to a mode selection unit 2211 for selecting a mode such as an ice-removing mode, and a ejector driving motor 2197, an electric heater 2156 and a pinion driving motor 2295 for controlling the process of making and removing ice, respectively.

Figure 36:
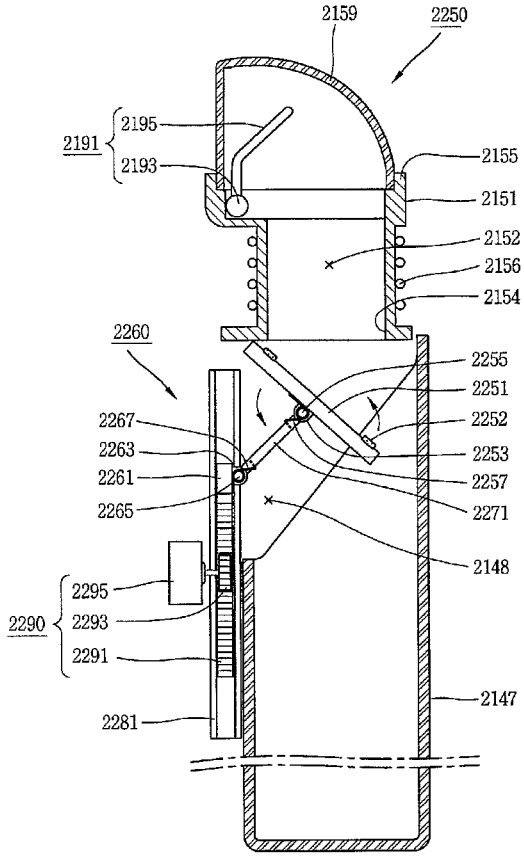
FIGS. 36 and 37 are views illustrating the operation of FIG. 35, respectively.

By such a configuration, when an ice-making mode is selected by the mode selection unit 2211, the controller 2210 controls the damper driving unit 2260 to block the discharge port 2154 of the ice tray 2151. More specifically, the controller 2210 controls the pinion driving motor 2295 to raise the lifting member 2261. If the lifting member 2261 is raised along the guide member 2281, then the connecting member 2271 and damper 2251 are also raised. If the lifting member 2261 continues to be raised, then an upper end of the damper 2251 is brought into contact with a bottom surface of the ice tray 2151. When the upper end of damper 2251 is contacted therewith, the damper 2251 cannot be raised any more, and then revolved around the revolving pin 2255 as illustrated in FIG. 36.

Figure 37:
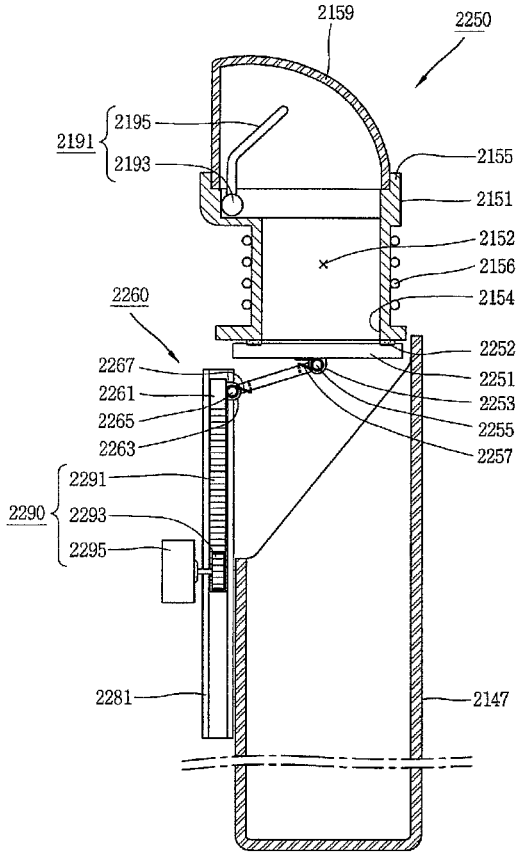

On the other hand, if the damper 2251 is stopped to be raised and started to be revolved, then connecting member 2271 is revolved around the revolving pin 2255 of the connecting member combining portion 2253. As illustrated in FIG. 37, if the damper 2251 is completely revolved to block the discharge port 2154, then the controller 2210 controls the pinion driving motor 2295 to stop the raising of the lifting member 2261. At this time, the damper spring 2257 and connecting member spring 2267 are compressed to accumulate elastic force when all the damper 2251 and connecting member 2271 are started to be revolved, and the damper 2251 can be brought into contact with a lower end of the ice tray 2151 by the elastic force.

If the discharge port 2154 is blocked and water is supplied into the ice tray 2151 and a predetermined time is passed to complete the process of making ice, then the controller 2210 applies power to the electric heater 2156. Next, the controller 2210 controls the pinion driving motor 2295 to allow the damper 2251 to open the discharge port 2154, thereby lowering the lifting member 2261 to an initial position.

If the lifting member 2261 is started to be lowered, then the damper 2251 and connecting member 2271 are started to be revolved to be disposed in a vertical direction by the elastic force of the damper spring 2257 and the connecting member spring 2267. By this, the discharge port 2154 of the ice tray 2151 is opened.

If the discharge port 2154 is opened and the ice 2153 within the cell 2152 is removed from the ice tray 2151, then the controller 2210 controls the ejector driving motor 2197 to allow the ejector 2191 to be revolved upward. The downward revolved ejector 2191 allows the each finger 2195 to presses the ice 2153 of the relevant cell 2152, thereby allowing the ice 2153 formed within the each cell 2152 to be fallen downward through the discharge port 2154. The fallen ice 2153 is stored in the ice bank 2147.

If the discharge of the ice 2153 is completed, then the controller 2210 controls the ejector driving motor 2197 to allow the ejector 2191 to be revolved upward. Here, the controller 2210 may control the damper 2251 to be revolved to a position for blocking the discharge port 2154 subsequent to discharging the ice 2153.

In the foregoing illustrated embodiment, as an example, it has been explained a case where an ice maker is provided at a refrigerating chamber door of the bottom freezer refrigerator, but it may be configured that the ice maker to be provided at a freezing chamber door of the side-by-side refrigerator. Also, the ice maker may be configured to be disposed inside the freezing chamber.

As described above, according to an embodiment of the present invention, there is provided an ejector disposed at an upper side of the ice tray, and a transfer unit for transferring the ice removed by the ejector in an axial direction of the ejector, and thus an ice bank is not necessarily disposed at a lower side of the ice tray to be protruded in a width direction, thereby drastically reducing the installation width of the ice tray and the ice bank.

By this, when the ice tray and the ice bank are provided at a freezing chamber door, the interference caused between the ice bank and foods can be suppressed when accommodating foods into the freezing chamber. Also, when an ice making chamber is formed at the refrigerating chamber door and the ice tray and ice bank are provided therein, the thickness (width) of the ice making chamber can be drastically reduced, thereby broadly utilizing the space in the refrigerator.

In addition, a cover for blocking an upper opening of the ice tray is provided, thereby preventing water within the ice tray from being overflowed out of the ice tray by external force. Especially, when the ice tray is provided at a door, water overflow of the ice tray due to opening and closing the door can be effectively prevented.

As described above, specific embodiments of the present invention are illustrated and described herein with reference to the accompanying drawings. However, the present invention can be implemented in various embodiments without departing from the spirit or gist of the invention, and thus the foregoing embodiments should not be limited to the content of the detailed description.

Furthermore, the foregoing embodiments should be broadly construed within the scope of the technical spirit defined by the appended claims even though they are not specifically disclosed in the detailed description herein. Moreover, all changes and modifications within the technical scope of the claims and the equivalent scope thereof should be construed to be included in the appended claims.

What is claimed is:

1. An ice maker for a refrigerator, comprising:
an ice tray having a plurality of cells;
an ejector configured to remove ice formed in the cells and support the ice placed thereon;
a transfer unit configured to transfer the ice that has been removed from the cells and placed on the ejector in the length direction of the ice tray;
an ice bank disposed at a lower side of the ice tray to accommodate ice transferred by a transfer unit; and
a cover configured to block an upper side of the ice tray,
wherein the ejector is disposed in the cover, and
wherein the ice bank is configured to have substantially the same width as that of the ice tray.

2. The ice maker for a refrigerator of claim 1, wherein the ejector comprises a shaft, a plate protruded at one side of the shaft, and a plurality of fingers protruded in a direction opposite to the plate at the other side of the shaft.

3. The ice maker for a refrigerator of claim 2, wherein the ejector is rotated forward or backward to allow the fingers to be revolved to pass through the cells.

4. The ice maker for a refrigerator of claim 1, wherein the ejector comprises a shaft; and a plurality of fingers protruded at both sides of the shaft.

5. The ice maker for a refrigerator of claim 1, wherein the transfer unit comprises a transfer screw; and a pusher moved along the transfer screw.

6. The ice maker for a refrigerator of claim 1,
wherein the ice bank is more protruded in the length direction of the ice tray.

7. The ice maker for a refrigerator of claim 1, wherein the transfer unit comprises a screw shaft; a screw fin spirally protruded at the screw shaft; and a screw shaft driving unit for providing a driving force to the screw shaft.

8. The ice maker for a refrigerator of claim 7, wherein the screw fin has a semi-circular shape.

9. The ice maker for a refrigerator of claim 8, further comprising:
a controller configured to control the screw shaft driving unit.

10. The ice maker for a refrigerator of claim 9, wherein the controller controls the screw shaft driving unit to allow the screw fin to be disposed at an upper side of the shaft when making ice.

11. A refrigerator, comprising:
a refrigerator body formed with a cooling chamber;
a door configured to open and close the cooling chamber; and
an ice maker of claim 1.

12. An ice maker for a refrigerator, comprising:
an ice tray having a plurality of cells provided with a discharge port at the bottom portion;
a cover configured to block an upper side of the ice tray;
an ice bank disposed at a lower side of the ice tray to accommodate ice transferred by a transfer unit in the length direction of the ice tray;
an ejector configured to press ice made in the ice tray;
a damper configured to open and close the discharge port; and
a damper driving unit configured to drive the damper,
wherein the ejector is disposed in the cover, and
wherein the ice bank is configured to have substantially the same width as that of the ice tray.

13. The ice maker for a refrigerator of claim 12, wherein the damper is vertically revolved around a revolving axis disposed at one side of the bottom portion of the ice tray.

14. The ice maker for a refrigerator of claim 12, wherein the damper opens and closes the discharge port while one side thereof moves horizontally and the other side thereof moves vertically.

15. The ice maker for a refrigerator of claim 14, further comprising:
a damper guide configured to guide the damper.

16. The ice maker for a refrigerator of claim 12, wherein the damper is brought into contact with the bottom portion of the ice tray to be revolved subsequent to its vertical movement when the discharge port is blocked.

17. The ice maker for a refrigerator of claim 16, wherein the damper driving unit comprises a lifting member being moved up and down; a connecting member for connecting the lifting member to the damper; and an elastic member for applying an elastic force to allow the lifting member and the connecting member to be vertically disposed, respectively.

18. A refrigerator, comprising:
a refrigerator body formed with a cooling chamber;
a door configured to open and close the cooling chamber; and
an ice maker of claim 12.

* * * * *